US012728457B2

(12) United States Patent
Ghotkar et al.

(10) Patent No.: US 12,728,457 B2
(45) Date of Patent: Sep. 8, 2026

(54) ZIGZAG FLOW REACTOR FOR HETEROGENOUS THERMOCHEMICAL REDUCTION

(71) Applicant: ARIZONA BOARD OF REGENTS ON BEHALF OF ARIZONA STATE UNIVERSITY, Scottsdale, AZ (US)

(72) Inventors: Rhushikesh Ghotkar, Tempe, AZ (US); Ryan Milcarek, Gilbert, AZ (US); Ivan Ermanoski, Tempe, AZ (US); James Miller, Albuquerque, NM (US); Roy Hogan, Jr., Albuquerque, NM (US)

(73) Assignee: ARIZONA BOARD OF REGENTS ON BEHALF OF ARIZONA STATE UNIVERSITY, Scottsdale, AZ (US)

( * ) Notice: Subject to any disclaimer, the term of this patent is extended or adjusted under 35 U.S.C. 154(b) by 314 days.

(21) Appl. No.: 18/385,905

(22) Filed: Oct. 31, 2023

(65) Prior Publication Data

US 2024/0261858 A1 Aug. 8, 2024

Related U.S. Application Data

(60) Provisional application No. 63/421,981, filed on Nov. 2, 2022.

(51) Int. Cl.
*B22F 9/20* (2006.01)
*C21B 13/00* (2006.01)

(52) U.S. Cl.
CPC ..... *B22F 9/20* (2013.01); *C21B 13/0033* (2013.01); *B22F 2201/02* (2013.01);
(Continued)

(58) Field of Classification Search
CPC .... B22F 9/20; B22F 2201/02; B22F 2202/01; B22F 2203/11; B22F 2304/10;
(Continued)

(56) References Cited

U.S. PATENT DOCUMENTS

2013/0068217 A1* 3/2013 Al-Ansary ..... F24S 23/70 126/714

OTHER PUBLICATIONS

Abedin, A.H. A Critical Review of Thermochemical Energy Storage Systems. The Open Renewable Energy Journal 2011, 4, 42-46, doi:10.2174/1876387101004010042.

(Continued)

*Primary Examiner* — Ricardo D Morales
(74) *Attorney, Agent, or Firm* — Fuller IP Law LLC; Rodney J. Fuller

(57) ABSTRACT

The disclosure concerns reactors for reducing metal oxide particles comprising: (a) a vertical heated channel; (b) a plurality of inclined, vertically stacked metal meshes, said meshes comprising: (i) a particle opaque portion comprising over about 50% of the meshes' length and having openings smaller than the smallest particle; and (ii) a particle transparent portion having openings large enough for particles to pass to the next level; (c) a vibration motor coupled to the meshes; and (d) an insulated chamber for storing the particles. Other aspects of the disclosure concern methods of reducing metal oxide particles. Yet other aspects concern thermochemical energy storage reactor devices comprising such reactors.

14 Claims, 21 Drawing Sheets

(52) U.S. Cl.
CPC ..... *B22F 2202/01* (2013.01); *B22F 2203/11* (2013.01); *B22F 2304/10* (2013.01)

(58) Field of Classification Search
CPC ..... C21B 13/0033; C21B 2300/04; C21B 13/0046; C21B 13/0053; C21B 13/0073
See application file for complete search history.

(56) References Cited

OTHER PUBLICATIONS

Agrafiotis, C.; Roeb, M.; Schmücker, M.; Sattler, C. Exploitation of Thermochemical Cycles Based on Solid Oxide Redox Systems for Thermochemical Storage of Solar Heat. Part 2: Redox Oxide-Coated Porous Ceramic Structures as Integrated Thermochemical Reactors/Heat Exchangers. Solar Energy 2015, 114, 440-458, doi: 10.1016/j.solener.2014.12.036.

Alloy 309 Stainless Steel Sheet Price Available online: https://www.steelemporium.co.in/309-stainless-steel-sheet-plate-suppliers.html (accessed on Oct. 31, 2022).

Alloy 330 Price in USA Available online: https://www.stindia.com/incoloy-alloy-330-supplier.html (accessed on Oct. 31, 2022).

Ambrosini, A.; Garino, T.; Nenoff, T.M. Synthesis and Characterization of the Double-Substituted Perovskites LaxSr1-XCo1-YMnyO3-δ for Use in High-Temperature Oxygen Separations. Solid State Ion 2006, 177, 2275-2279, doi:10.1016/j.ssi.2006.05.023.

Babiniec, S.M.; Coker, E.N.; Miller, J.E.; Ambrosini, A. Doped Calcium Manganites for Advanced High-Temperature Thermochemical Energy Storage. Int J Energy Res 2016, 40, 280-284, doi:10.1002/er.3467.

Babiniec, S.M.; Coker, E.N.; Miller, J.E.; Ambrosini, A. Investigation of LaxSr1-XCoyM1-YO3-δ (M=Mn, Fe) Perovskite Materials as Thermochemical Energy Storage Media. Solar Energy 2015, 118, 451-459, doi:10.1016/j.solener.2015.05.040.

Block, T.; Schmücker, M. Metal Oxides for Thermochemical Energy Storage: A Comparison of Several Metal Oxide Systems. Solar Energy 2016, 126, 195-207, doi:10.1016/j.solener.2015.12.032.

Brendelberger, S.; Roeb, M.; Lange, M.; Sattler, C. Counter Flow Sweep Gas Demand for the Ceria Redox Cycle. Solar Energy 2015, 122, 1011-1022, doi:10.1016/j.solener.2015.10.036.

Brendelberger, S.; von Storch, H.; Bulfin, B.; Sattler, C. Vacuum Pumping Options for Application in Solar Thermochemical Redox Cycles—Assessment of Mechanical-, Jet- and Thermochemical Pumping Systems. Solar Energy 2017, 141, 91-102, doi:10.1016/j.solener.2016.11.023.

Bulfin, B.; Call, F.; Lange, M.; Lubben, O.; Sattler, C.; Pitz-Paal, R.; Shvets, I. v. Thermodynamics of CeO 2 Thermochemical Fuel Production. Energy & Fuels 2015, 29, 1001-1009, doi:10.1021/ef5019912.

Bulfin, B.; Vieten, J.; Agrafiotis, C.; Roeb, M.; Sattler, C. Applications and Limitations of Two Step Metal Oxide Thermochemical Redox Cycles; A Review. J Mater Chem A Mater 2017, 5, 18951-18966, doi:10.1039/c7ta05025a.

Cot-Gores, J.; Castell, A.; Cabeza, L.F. Thermochemical Energy Storage and Conversion: A-State-of-the-Art Review of the Experimental Research under Practical Conditions. Renewable and Sustainable Energy Reviews 2012, 16, 5207-5224, doi:10.1016/j.rser.2012.04.007.

De la Calle, A.; Ermanoski, I.; Stechel, E.B. Towards Chemical Equilibrium in Thermochemical Water Splitting. Part 1: Thermal Reduction. Int J Hydrogen Energy 2021, doi:10.1016/j.ijhydene.2021.07.167.

Ehrhart, B.; Coker, E.; Siegel, N.; Weimer, A. Thermochemical Cycle of a Mixed Metal Oxide for Augmentation of Thermal Energy Storage in Solid Particles. Energy Procedia 2014, 49, 762-771, doi:10.1016/j.egypro.2014.03.082.

Ermanoski, I. Cascading Pressure Thermal Reduction for Efficient Solar Fuel Production. Int J Hydrogen Energy 2014, 39, 13114-13117, doi:10.1016/j.ijhydene.2014.06.143.

Ermanoski, I.; Stechel, E.B. Thermally-Driven Adsorption/Desorption Cycle for Oxygen Pumping in Thermochemical Fuel Production. Solar Energy 2020, 198, 578-585, doi:10.1016/j.solener.2020.01.050.

Farr, T.P.; Nguyen, N.P.; Bush, H.E.; Ambrosini, A.; Loutzenhiser, P.G. Perovskites for Solar Thermochemical Air Separation. Materials 2020, 13.

Flamant, G.; Gauthier, D.; Benoit, H.; Sans, J.L.; Garcia, R.; Boissière, B.; Ansart, R.; Hemati, M. Dense Suspension of Solid Particles as a New Heat Transfer Fluid for Concentrated Solar Thermal Plants: On-Sun Proof of Concept. Chem Eng Sci 2013, 102, 567-576, doi:10.1016/j.ces.2013.08.051.

Frisk, K.; Selleby, M. The Compound Energy Formalism: Applications. J Alloys Compd 2001, 320, 177-188, doi:10.1016/S0925-8388(00)01482-1.

Gorman, B.T.; Lanzarini-Lopes, M.; Johnson, N.G.; Miller, J.E.; Stechel, E.B. Techno-Economic Analysis of a Concentrating Solar Power Plant Using Redox-Active Metal Oxides as Heat Transfer Fluid and Storage Media. Front Energy Res 2021, 9, 1-18, doi:10.3389/fenrg.2021.734288.

Ho, C.K. A Review of High-Temperature Particle Receivers for Concentrating Solar Power. Appl Therm Eng 2016, 109, 958-969, doi:10.1016/j.applthermaleng.2016.04.103.

Ho, C.K.; Christian, J.M. Evaluation of Air Recirculation for Falling Particle Receivers. ASME 2013 7th Int. Conf. on Energy Sustainability Collocated with the ASME 2013 Heat Transfer Summer Conf. and the ASME 2013 11th Int. Conf. on Fuel Cell Science, Engineering and Technology, ES 2013 2013, doi:10.1115/ES2013-18236.

Ho, C.K.; Christian, J.M.; Yellowhair, J.; Armijo, K.; Kolb, W.J.; Jeter, S.; Golob, M.; Nguyen, C. Performance Evaluation of a High-Temperature Falling Particle Receiver. In Proceedings of the vol. 1: Biofuels, Hydrogen, Syngas, and Alternate Fuels; CHP and Hybrid Power and Energy Systems; Concentrating Solar Power; Energy Storage; Environmental, Economic, and Policy Considerations of Advanced Energy Systems; Geothermal, Ocean, and Emerging E; American Society of Mechanical Engineers, Jun. 26, 2016; vol. 1, pp. 1-30.

Ho, C.K.; Christian, J.M.; Yellowhair, J.; Siegel, N.; Jeter, S.; Golob, M.; Abdel-Khalik, S.I.; Nguyen, C.; Al-Ansary, H. On-Sun Testing of an Advanced Falling Particle Receiver System. AIP Conf Proc 2016, 1734, doi:10.1063/1.4949074.

Imponenti, L.; Albrecht, K.J.; Kharait, R.; Sanders, M.D.; Jackson, G.S. Redox Cycles with Doped Calcium Manganites for Thermochemical Energy Storage to 1000□° C. Appl Energy 2018, 230, 1-18, doi:10.1016/j.apenergy.2018.08.044.

Inconel 625 Price per Kg in India Available online: https://www.stindia.com/inconel-alloy-600-625-718-price-per-kg-india.html (accessed on Oct. 31, 2022).

Li, S.; Wheeler, V.M.; Kreider, P.B.; Bader, R.; Lipiński, W. Thermodynamic Analyses of Fuel Production via Solar-Driven Non-Stoichiometric Metal Oxide Redox Cycling. Part 2. Impact of Solid-Gas Flow Configurations and Active Material Composition on System-Level Efficiency. Energy and Fuels 2018, 32, 10848-10863, doi:10.1021/acs.energyfuels.8b02082.

Li, S.; Wheeler, V.M.; Kreider, P.B.; Lipiński, W. Thermodynamic Analyses of Fuel Production via Solar-Driven Non-Stoichiometric Metal Oxide Redox Cycling. Part 1. Revisiting Flow and Equilibrium Assumptions. Energy and Fuels 2018, 32, 10838-10847, doi:10.1021/acs.energyfuels.8b02081.

Ma, Z.; Glatzmaier, G.; Mehos, M. Fluidized Bed Technology for Concentrating Solar Power with Thermal Energy Storage. Journal of Solar Energy Engineering, Transactions of the ASME 2014, 136, 1-9, doi:10.1115/1.4027262.

Mauler, L.; Duffner, F.; Leker, J. Economies of Scale in Battery Cell Manufacturing: The Impact of Material and Process Innovations. Appl Energy 2021, 286, 116499, doi:10.1016/j.apenergy.2021.116499.

McDaniel, A.H.; Ambrosini, A.; Coker, E.N.; Miller, J.E.; Chueh, W.C.; O'Hayre, R.; Tong, J. Nonstoichiometric Perovskite Oxides

(56) References Cited

OTHER PUBLICATIONS for Solar Thermochemical H2 and CO Production. Energy Procedia 2014, 49, 2009-2018, doi:10.1016/j.egypro.2014.03.213.
Miller, J.E.; Ambrosini, A.; Babiniec, S.M.; Coker, E.N.; Ho, C.K.; Al-Ansary, H.; Jeter, S.M.; Loutzenhiser, P.G.; Johnson, N.G.; Stechel, E.B. High Performance Reduction/Oxidation Metal Oxides for Thermochemical Energy Storage (PROMOTES). In Proceedings of the vol. 1: Biofuels, Hydrogen, Syngas, and Alternate Fuels; CHP and Hybrid Power and Energy Systems; Concentrating Solar Power; Energy Storage; Environmental, Economic, and Policy Considerations of Advanced Energy Systems; Geothermal, Ocean, and Emerging E; American Society of Mechanical "published Jun. 26-30, 2016".
Muroyama, A.P.; Schrader, A.J.; Loutzenhiser, P.G. Solar Electricity via an Air Brayton Cycle with an Integrated Two-Step Thermochemical Cycle for Heat Storage Based on Co3O4/CoO Redox Reactions II: Kinetic Analyses. Solar Energy 2015, 122, 409-418, doi:10.1016/j.solener.2015.08.038.
Nobuyuki Gokon, Takehiro Yawata, Selvan Bellan, Tatsuya Kodama, Hyun-Seok Cho. Thermochemical behavior of perovskite oxides based on LaxSr1-x(Mn, Fe, Co)O3-d and BaySr1-yCoO3-d redox system for thermochemical energy storage at high temperatures. Energy 171 (2019) 971e980.
Prasad S., J.; Muthukumar, P.; Desai, F.; Basu, D.N.; Rahman, M.M. A Critical Review of High-Temperature Reversible Thermochemical Energy Storage Systems. Appl Energy 2019, 254, 113733, doi: 10.1016/j.apenergy.2019.113733.
Prieto, C.; Cooper, P.; Fernandez, A.I.; Cabeza, L.F. Review of Technology: Thermochemical Energy Storage for Concentrated Solar Power Plants. Renewable and Sustainable Energy Reviews 2016, 60, 909-929, doi: 10.1016/j.rser.2015.12.364.
Sandlin, M.; Abdel-Khalik, S.I. A Study of Granular Flow through Horizontal Wire Mesh Screens for Concentrated Solar Power Particle Heating Receiver Applications—Part I: Experimental Studies and Numerical Model Development. Solar Energy 2018, 169, 1-10, doi:10.1016/j.solener.2018.03.036.
Sandlin, M.; Abdel-Khalik, S.I. A Study of Granular Flow through Horizontal Wire Mesh Screens for Concentrated Solar Power Particle Heating Receiver Applications—Part II: Parametric Model Predictions. Solar Energy 2018, 174, 1252-1262, doi:10.1016/j.solener.2018.04.042.
Schmidt, O.; Melchior, S.; Hawkes, A.; Staffell, I. Projecting the Future Levelized Cost of Electricity Storage Technologies. Joule 2019, 3, 81-100, doi:10.1016/j.joule.2018.12.008.
Schrader, A.J.; Bush, H.E.; Ranjan, D.; Loutzenhiser, P.G. Aluminum-Doped Calcium Manganite Particles for Solar Thermochemical Energy Storage: Reactor Design, Particle Characterization, and Heat and Mass Transfer Modeling. Int J Heat Mass Transf 2020, 152, 119461, doi:10.1016/j.ijheatmasstransfer.2020.119461.
Schrader, A.J.; Schieber, G.L.; Ambrosini, A.; Loutzenhiser, P.G. Experimental Demonstration of a 5 KWth Granular-Flow Reactor for Solar Thermochemical Energy Storage with Aluminum-Doped Calcium Manganite Particles. Appl Therm Eng 2020, 173, 115257, doi:10.1016/j.applthermaleng.2020.115257.
Shu, L.; Sunarso, J.; Hashim, S.S.; Mao, J.; Zhou, W.; Liang, F. Advanced Perovskite Anodes for Solid Oxide Fuel Cells: A Review. Int J Hydrogen Energy 2019, 44, 31275-31304, doi:10.1016/j.ijhydene.2019.09.220.
Stainless Steel 310 Price per Kg in USA Available online: https://www.fastwell.in/310s-stainless-steel-supplier-manufacturer.html (accessed on Oct. 31, 2022).
Wu, W.; Amsbeck, L.; Buck, R.; Uhlig, R.; Ritz-Paal, R. Proof of Concept Test of a Centrifugal Particle Receiver. Energy Procedia 2014, 49, 560-568, doi:10.1016/j.egypro.2014.03.060.
Xu, M.; Ermanoski, I.; Stechel, E.B.; Deng, S. Oxygen Pumping Characteristics of YBaCo4O7+δ for Solar Thermochemical Cycles. Chemical Engineering Journal 2020, 389, 124026, doi:10.1016/j.cej.2020.124026.

* cited by examiner

ZIGZAG FLOW REACTOR FOR HETEROGENOUS THERMOCHEMICAL REDUCTION

CROSS-REFERENCE TO RELATED APPLICATIONS

This application claims the benefit of U.S. Provisional Application No. 63/421,981, entitled "Zigzag Flow Reactor for Heterogeneous Thermal Reduction" which was filed Nov. 2, 2022, the entire disclosure of which is hereby incorporated herein by this reference.

ACKNOWLEDGMENT OF GOVERNMENT SUPPORT

This invention was made with government support under Grant No. DE-EE0008991 awarded by the U.S. Department of Energy. The government has certain rights in the invention.

TECHNICAL FIELD

Embodiments of the present disclosure relate to methods and devices for reducing metal oxide particles and thermochemical energy storage devices utilizing such methods.

BACKGROUND

As the world gears up for the ongoing renewable energy revolution, the temporal variability of the renewable sources remains a big headache for designing a reliable electricity grid. A multi-level energy storage infrastructure is thus necessary to maintain high, year-round dispatchability. No technology that currently exists is ideally suited to meet the medium term energy storage needs (20-200 hrs.). The materials research on thermochemical energy storage (TCES) shows that TCES holds great promise in meeting the medium term demand.

In TCES, hot and reduced reactive metal oxide ($MO_x$) particles serve as storage media. Two types of $MO_x$ in particular, have piqued the interest of thermochemistry researchers. Stoichiometric $MO_x$, transition between two discrete reduction states representing the charging and discharging steps (e.g., $CO_3O_4 \leftrightarrows CoO$). Non-stoichiometric $MO_x$ on the other hand, exhibit continuous reduction states depending upon the temperature and oxygen partial pressure ($pO_2$) in the environment (e.g., $CaAl_{0.2}Mn_{0.8}O_3\text{-}\delta_{in} \leftrightarrows CaAl_{0.2}Mn_{0.8}O_3\text{-}\delta_{out}$, where $\delta_{in}$ and $\delta_{out}$ are the initial and final reduction extents). The main appeal of non-stoichiometric oxides, especially perovskites, is the wide material space and the possibility of tuning them to maximize the stored energy and minimize the cost of storage per unit stored energy. Thus, for the purposes of this disclosure, $MO_x$ always refers to non-stoichiometric $MO_x$.

FIG. 1 shows the schematic of the charging and discharging steps in thermochemical energy storage cycle in a power grid. During the charging step, a reduction reactor thermally reduces the preheated $MO_x$ particles (T~550 °C). The heat for this process is supplied from the off-peak power from electrical or thermal sources. During the reduction process, the $MO_x$ particles release $O_2$ gas swept out of reactor by an inert gas (typically $N_2$). The hot and reduced metal oxide particles serve as storage media in a $MO_{x-\delta}$ particle storage at ~1000 °C. During the discharging step, stored $MO_{x-\delta}$ particles are sent to the energy recovery reactor (ERR) where they reoxidize using air/$O_2$ which releases the stored sensible and chemical energy. This stored energy supplies heat for operating a power cycle to supplement the power plant output thus maintaining grid stability. One output of the ERR are the $MO_x$ particles that go back into the cycle for reduction.

The reduction reactor requires several subsystems like the particle flow channel, the particle feed system, the heating systems, the particle storage chambers etc. for continuous operation. However, the particle flow channel (used interchangeably with "the reactor"), where the particles and $N_2$ interact to exchange $O_2$ is the most technically challenging and is the major focus of this work. It is the objective of this disclosure to come up with the design of a reduction reactor that offers minimization of the TCES levelized cost of storage (LCOS). Achieving three key reactor sub-objectives i.e., (i) high output energy storage density (W) to minimize the required reactant quantities, (ii) high power density ($P_D$) to minimize the reactor size and (iii) affordable scalability to grid levels will go a long way in reducing the overall LCOS.

There is a need in the art for practical TCES reactors.

SUMMARY

The technology of the disclosure concerns thermochemical energy storage reactor devices and methods. The reactor devices utilize temperature and oxygen partial pressure dependent transition of continuous reduction states of non-stoichiometric metal oxide compounds, $MO_x$. A zigzag flow reactor (ZFR) has been designed to allow for flow of the $MO_x$ particles that are heated and reduced (emit $O_2$) in the presence of a counterflowing inert sweep gas. The reduced particles are stored until the thermal energy is needed wherein the particles are exposed to $O_2$, the $MO_x$ is then oxidized and the stored thermal energy is emitted. The process is reversible and repeatable and the ZFR is simple and scalable. Importantly, the zigzag flow reactor (ZFR) design with counter flow sweep gas carefully controls and maximizes the power density.

In some aspects, the disclosure concerns reactors for reducing metal oxide particles comprising: (a) a vertical heated channel; (b) a plurality of inclined, vertically stacked metal meshes, said meshes comprising: (i) a particle opaque portion comprising over 50% of the meshes' length and having openings smaller than the smallest particle; and (ii) a particle transparent portion having openings large enough for particles to pass to the next level; (c) a vibration motor coupled to the meshes; and (d) an insulated chamber for storing the particles.

In some embodiments, the particle opaque portion comprising over about 50%, about 75%, about 80% or about 90% of the meshes' length. In the context of the present description and the claims that follow, "about" means within plus or minus 5% of the described quantity, whether it be relative (e.g., percentages, etc.) or absolute (e.g., particle diameters, temperatures, etc.).

In certain embodiments, the insulated chamber stores the particles under a reduced $O_2$ environment.

In some embodiments, the stacked metal meshes comprise openings that are at least 30% of the surface area of the meshes. In other embodiments, the stacked metal meshes comprise openings that are about 40% to about 50% of the surface area of the meshes.

Some metal oxide particles have a particle size of about 25 μm to about 500 μm. Certain metal oxide particles have a particle size of about 25 μm to about 150 μm or about m to about 300 μm.

In some embodiments, a sweep gas (SG) flows counter current to a flow or movement of the metal oxide particles. The sweep gas can be any suitable gas. In certain embodiments, the SG is air, nitrogen, steam or hydrogen.

Certain embodiments, additionally comprising a hopper to feed metal oxide particles to the vertical heated chamber.

Some vertical heated chambers have a temperature of about 500 °C to about 1200 °C. Certain vertical chambers have a temperature of about 500 °C to about 1200 °C or about 600 °C to about 1000 °C.

In some embodiments, the plurality of inclined, vertically stacked metal meshes are inclined at about 10 degrees to about 25 degrees.

Other aspects concern thermochemical energy storage reactor devices comprising any of the reactors for reducing metal oxide particles described herein.

Yet another aspect concerns methods of reducing metal oxide particles comprising: (a) introducing the metal oxide particles into a vertical heated channel; the vertical heated chamber having upper and lower portions and wherein the vertical heated channel comprises a plurality of inclined, vertically stacked metal meshes each sloping from an upper portion of the vertical heated chamber to a lower portion of the vertical heated chamber, said meshes comprising: (i) a particle opaque portion comprising over 50% of the meshes' length and having a plurality of openings smaller than the smallest metal oxide particle; and (ii) a particle transparent portion having openings large enough for the largest metal oxide particle to pass to the next mesh; (b) vibrating the meshes with a vibration motor coupled to the meshes; (c) allowing the metal oxide particles to flow from meshes in an upper portion of the vertical heated channel to meshes at a lower portion of the vertical heated channel and (d) storing the reduced metal oxide particles in an insulated chamber that is positioned at the bottom of the vertical heated channel.

In some embodiments, the particle opaque portion comprising over about 50%, about 75%, about 80% or about 90% of the meshes' length.

In certain embodiments, the insulated chamber stores the particles under a reduced $O_2$ environment.

Some stacked metal meshes comprise openings that are at least about 30% of the surface area of the meshes. Other stacked metal meshes comprise openings that are about 40% to about 50% of the surface area of the meshes.

Certain metal oxide particles have a particle size of 25 μm to about 500 μm.

In some embodiments, a sweep gas (SG) flow counter current to the metal oxide particles. Any suitable sweep gas may be used.

In certain embodiments, the metal oxide particles comprise one or more perovskite. Some perovskites include $La_xSr_{1-x}(Mn, Fe, Co)O_{3-\delta}$, and $Ba_ySr_{1-y}CoO_{3-\delta}$ perovskite oxide powders. Such compositions are described in Gokon, et al., *Energy* 171 (2019) 971-980. Other compounds are of the formula $La_xSr_{1-x}CoyMn_{1-y}O_{3-\delta}$ and $LaxSr_{1-x}CoyFe_{1-y}O_{3-\delta}$ as described in Babiniec, et. al., *Solar Energy* 118 (2015) 451-459.

Any suitable means may be used to feed the metal oxide particles to the vertical heated chamber. In some embodiments, the metal oxide particles are fed to the vertical heated chamber by a hopper.

In certain embodiments, the vertical heated chamber has a temperature of about 500 °C to about 2000 °C.

In some embodiments, the plurality of inclined, vertically stacked metal meshes are inclined at about 10 to about 25 degrees.

In certain embodiments, the insulated chamber is maintained at a temperature below about 500 °C.

DETAILED DESCRIPTION

Figure 1:
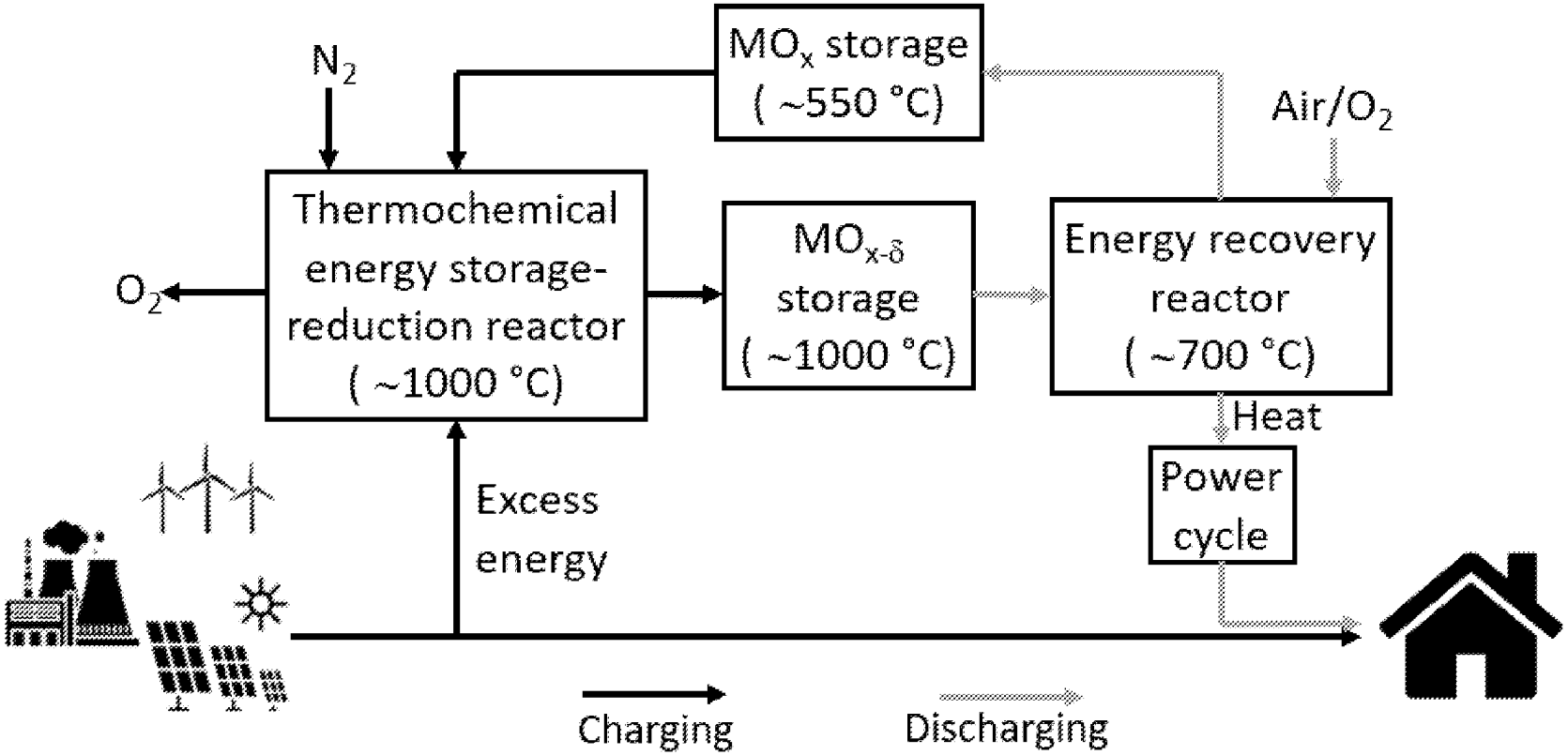
FIG. 1 shows charging and discharging steps with thermochemical energy storage cycle.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

In some embodiments, particle flow with high and controllable τR for efficient particle heating is a primary objective of the reactor, the particle receiver designs from the related thermal energy storage literature offer interesting possibilities. For example, obstructed flow receivers (OFRe) like meshes and chevron-shaped mesh structures impede the free fall of particles thereby increasing τR. Another way of obstructing the particle flow is by using the inclined plane reactor (IPR) as utilized in STInGR. These designs offer potential for simple scalable designs with potential for high τR as well as countercurrent particle gas flow.

Combining the ideas of OFRe and IPR, this disclosure discloses a novel TCES-RR design called zigzag flow reactor (ZFR) as a candidate ideally suited for TCES. An equilibrium model of ZFR helps to understand the limits of its performance. CFD and analytical diffusion models shed light on the PGM in ZFR and strategies to maximize energy storage density. A scaling model for ZFR provides insights into the reactor cost scaling for grid scale applications. In relevant sections, the performance comparison of ZFR with other common reactor design concepts to highlight the benefits of ZFR. Finally, a full prototype operated under particle and ISG flow proves the concept of ZFR.

Maximizing Energy Storage Density

The energy storage density (W) is first and foremost depends upon the reactive metal oxide. W is a function of material properties like specific heat and reduction enthalpy. Perovskites, or materials having the perovskite structure, offer a wide range of options to choose from depending upon the operational temperatures. Studies of the potential of the metal oxide $(Co,Ni)Fe_2O_4$ as thermochemical energy storage media have been performed in the art. Other perovskites like $La_xSr_{1-x}Co_yM_{1-y}O_{3-\delta}$ as potential candidates for TCES have been studied. There is no consensus yet among thermochemical researchers as to which oxide is ideal with respect to the overall techno-economics of TCES. This disclosure chose the perovskite CAM28 as the illustrative reactive $MO_x$ as literature shows that it is suitable for TCES applications.

Thus, the reduction reaction that is of interest to this disclosure is shown in

Eq. 1.

$$CaAl_{0.2}Mn_{0.8}O_{3-\delta_{in}} \rightarrow CaAl_{0.2}Mn_{0.8}O_{3-\delta_{out}} + \frac{\Delta\delta}{2}O_2 \quad \text{Eq. 1}$$

In *Eq.* 1, $\Delta\delta = \delta_{out} - \delta_{in}$.

Maximizing Chemically Stored Energy

Figure 2:
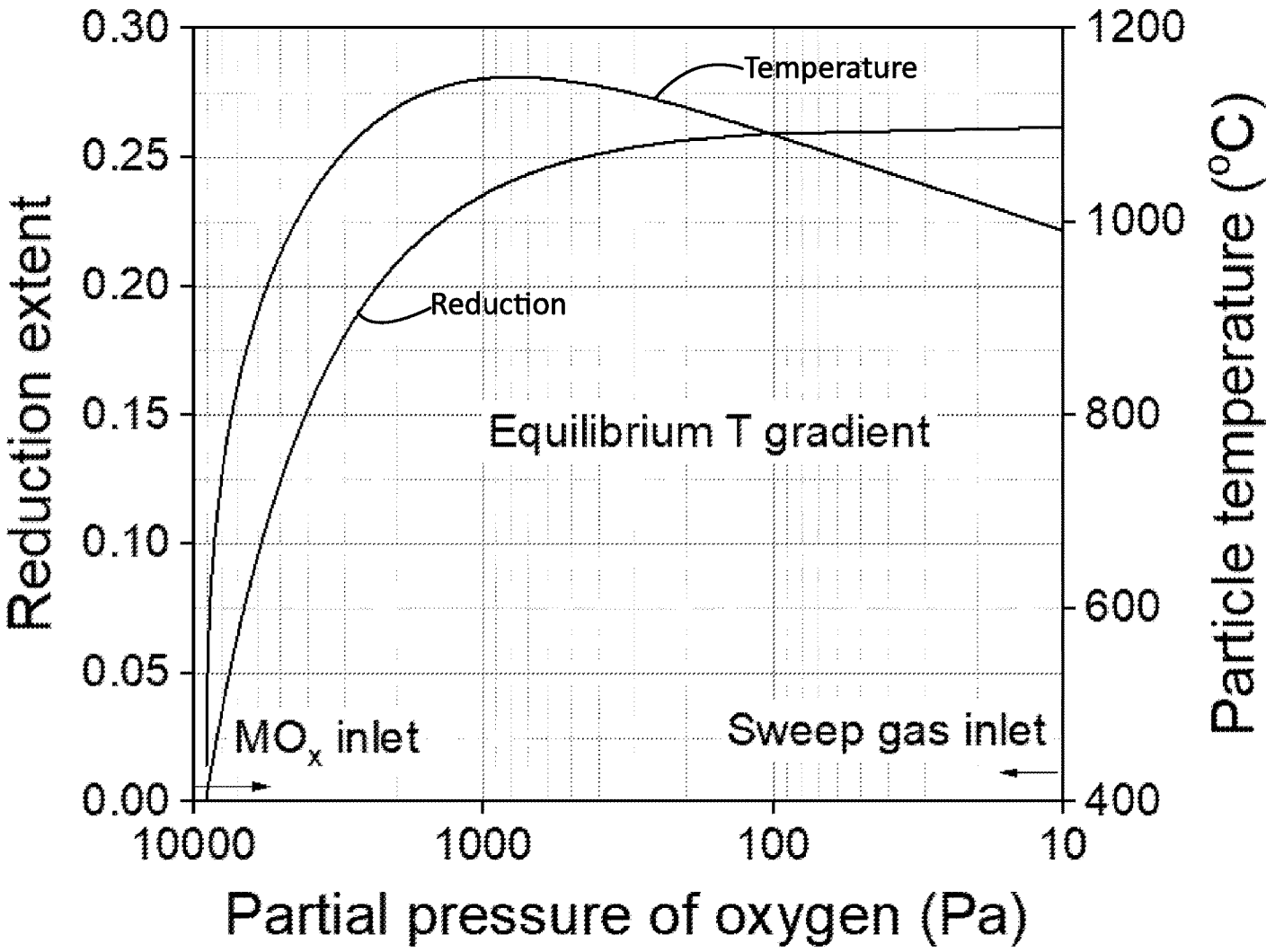
FIG. 2 shows variable temperature gradient to approach equilibrium in a countercurrent flow reactor with infinitesimally small reaction steps.

One aspect of increasing W is to maximize Δδ and the chemically stored energy. According to the art, the most important step in designing an effective reactor is to allow the reduction reaction to approach chemical equilibrium which maximizes the utilization of the $MO_x$'s chemical potential. Their study details the requirement of variable temperature (FIG. 2) countercurrent flowing reactor with infinitesimally small reaction steps to approach equilibrium. In a countercurrent flow reactor, reactants and products enter and exit the reactor at opposite reactor ends respectively. The ideal reactor also necessitates fast $O_2/N_2$ diffusion along the entire reaction path to remove the evolved $O_2$. In FIG. 2, the S value initially increases rapidly with temperature rise along the reaction path before equilibrating at a constant value (equilibrium) at the particle exit.

Though the art has applied the concept for a two-step WS reaction, it applies to all thermochemical reactors with solid-gas mixing. However, the art only talks about a theoretical reactor with infinite steps, leaving the need for a practical design that can still allow approach reaction equilibrium. The art also talks about maximizing Δδ which only maximizes the chemically stored energy. Instead, the focus ought to be on maximizing the total energy storage density (sensible+chemical) to understand all the avenues of minimizing LCOS. Models of the art suggest that high temperature and low $pO_2$ leads to high energy storage densities.

Maximizing Sensibly Stored Energy

The second aspect of increasing W is to maximize the storage temperatures and the sensibly stored energy. Though several potential methods are available for reactor heating, concentrated solar power (CSP) is the most popular way in literature to supply this heat. But, in some embodiments, our disclosure favors electrical heating over solar thermal due to (i) better control over the temperature gradient and avoidance of hotspots, (ii) wider applicability to both thermal and electrical sources, (iii) independence from the geographical requirements.

Power density ($P_D$), one of the most understudied parameter in thermochemical literature, and scaling costs are interdependent parameters that depend primarily on the reactor geometry. A high $P_D$ implies a compact device offering affordable scaling. Analogously, an efficiently scalable device reduces its unit size at larger scales, e.g., Li-ion battery.

The reactor geometry houses two main components, (i) the particle flow mechanism (ii) the $O_2$ removal mechanism. Since most of the previous TCES studies were material oriented, understanding of the critical reactor design features is missing from the literature. It is known that accommodation of reaction kinetics→approach reaction equilibrium. Accommodation of reaction kinetics necessarily freezes two aspects critical for the potential reactor geometry: (i) a high particle residence time, (ii) a high degree of particle gas mixing. As an example, the previous attempt by attributes low particle residence time as a one of the primary reason for their observed low $\Delta\delta$(~0.01). Their study also did not incorporate particle gas mixing considerations in their reactor design.

Particle Flow Mechanisms

Though few in TCES literature, the sister fields of thermal energy storage and two step W-S offer interesting candidate designs. Mechanized particle flow systems like those involving fluidized beds offer high particle gas mixing but have inherently poor scalability due to parasitic power requirements. Free falling particle designs such as the particle curtains offer a simple particle flow mechanism but suffer from scaling issues and low $\tau_R$. Obstructed flow reactors where mechanical obstructions like meshes or the inclined plane impede the free failing particles, show potential for improved scalability and $\tau_R$, than other designs.

Oxygen Removal Mechanisms

The most commonly used methods of removing the evolved $O_2$ are (i) vacuum pumping, (ii) inert sweep gas. Though several authors have modeled the impact of both on process efficiency, it is not clear which method will address the overall operational costs. This disclosure favors inert gas sweep over vacuum pumping due to the latter's poor efficiency and high costs. Another advantage of inert gas sweep is enabling the recommended countercurrent flow between the solid and the gas phases along the reaction path. Authors have also explored other methods like sorption pumping and oxygen conducting membranes for TCES application.

This disclosure concerns a novel design for the thermochemical reduction reactor, called the Zigzag Flow Reactor (ZFR), as ideally suited for TCES application. This reactor is electrically heated to increase its applicability beyond just thermal sources. This disclosure, through an analytical model, first identifies the requirements for approaching reaction equilibrium in a finite number of steps allowing for a practical reaction path that can approach equilibrium. This model sets the operational targets for the ZFR, to maximize its output energy storage density. Then after verifying that the ZFR can meet the requirements of the discretized equilibrium model, a laboratory prototype proves the concept of the ZFR. Finally, the disclosure describes a model of the grid scale ZFR and models the material costs of scaling the ZFR. The analytical/CFD models and experiments show that the ZFR offers the opportunity for a high output energy storage density, high power density and affordably scalable TCES reduction reactor.

Methods

In thermochemical energy storage (TCES), the output energy storage density (W) depends on two factors: (i) storage temperature, assumed equal to output particle temperature, ($T_{R,out}$) and (ii) output particle reduction extent ($\delta_{out}$). Initially modeling the problem of maximizing $\delta_{out}$ in countercurrent flow reactors proposed a countercurrent flow reaction path with a linear $\delta$-p* relationship $$\left(p^* = \frac{pO_2}{P_{sys} - pO_2}, P_{sys} \rightarrow \text{system pressure}\right).$$

Then the model was used to propose the variable temperature reduction as a means to approach reaction equilibrium at each infinitesimally small reaction step. This disclosure concerns the ideal reactor to understand the requirements of discretizing the ideal reaction path which contains infinitely many steps into finite number of parts. Such a discretization, if possible, will provide the requirements for a practical reactor that can approach reaction equilibrium. This model also helps optimize the reaction parameters to maximize W.

This disclosure considers three reactor geometries as potential candidates for the reduction reactor. The reactor geometry suitable for this application should meet the requirements of the discretized equilibrium model. The first two are the inclined plane reactor (IPR) and the obstructed flow reactor (OFR). This disclosure proposes the third candidate design called the Zigzag flow reactor (ZFR).

Figure 3:
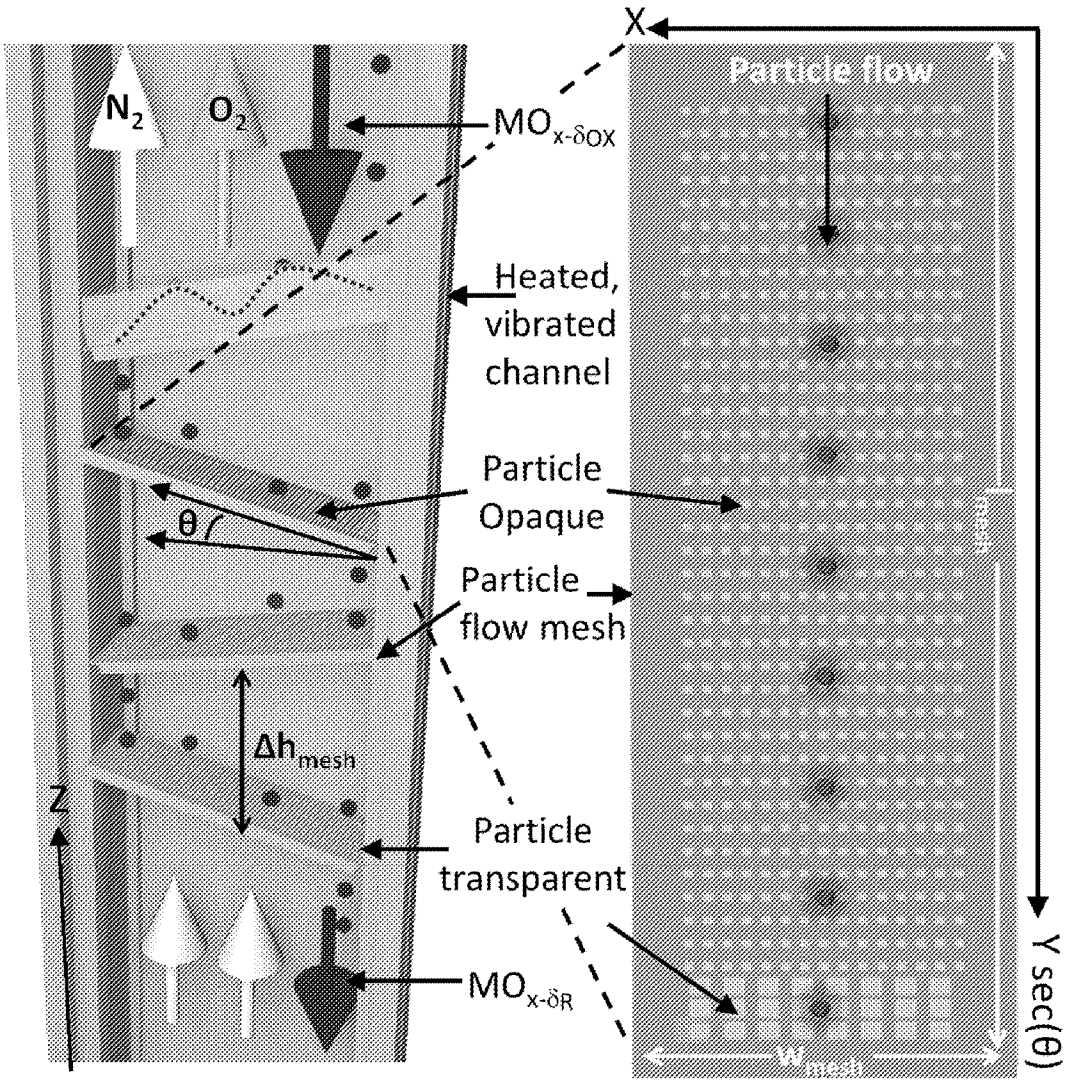
FIG. 3(*a*) ZFR Cross-Section With Particle and Gas Flow Directions; (b) Enlarged Particle Flow Mesh View. Note Particle Opaque and Particle-Transparent Sections, θ=Incline Angle~15

FIG. 3 shows the ZFR schematic that consists of vertical heated channel in which $MO_{x-\delta_{in}}$ particles flow in an externally vibrated cavity along slightly inclined, vertically stacked metal meshes. The mesh consists of two parts: (i) a particle-opaque portion and (ii) a particle-transparent portion. The particle-opaque portion which covers the majority of the mesh length (>90%), has openings smaller than the smallest available particle diameter, preventing particles from seeping through. At the end of each mesh, a small open area (particle-transparent portion) allows the particles to fall onto the next mesh. Though the meshes guide the particle in the zigzag pattern (hence the name), their high open area (~40-50%) makes them transparent to $N_2$ flow, thus offering a negligible pressure drop. Electrical heaters heat the cavity of particles while the countercurrent flowing $N_2$ picks up the evolved $O_2$. This creates a counterflow-crossflow interaction of $N_2$ and particles. The reduced $M_{x-\delta_{out}}$ particles serve as storage media in an insulated chamber for a period of several days.

As mentioned above, the cavity and the meshes are externally vibrated. There are numerous ways to impart vibration to the cavity and meshes. In some embodiments, the means for vibration is a vibration motor. In the context of the present description and the claims that follow, a vibration motor is a device that converts a form of energy into a vibration. Examples include, but are not limited to, an electric/mechanical device, a pneumatic device, a hydraulic device, and the like. In certain embodiments, the mechanical device may use an electric motor to rotate an offset mass to create a vibration. In some embodiments, the vibration motor may be controlled for vibration frequency and amplitude by the speed of rotation of the electric motor. In some embodiments, the vibration motor is directly coupled to the vertical heated channel and/or the plurality of inclined, vertically stacked metal meshes. In other embodiments, the vibration motor may be coupled to the vertical heated channel and/or meshes through a rod or other intermediate structure.

As described earlier, the discretized countercurrent reactor can theoretically approach equilibrium if reaction steps offer high particle gas mixing. This necessitates low cross sectional particle distribution thus minimizing the particle-particle interactions. Absence of such distribution can cause local $O_2$ accumulation near the particle vicinity affecting particle reduction and poor utilization of the supplied $N_2$. This is illustrated by a 2-D CFD model (COMSOL multiphysics) of the three candidate geometries. This model assumes stationary particles, infinitely fast particle kinetics and Fick's law driven diffusion kinetics. The model evaluates the steady state $pO_2$ in the pure $N_2$ ($pO_{2,in}$=10 Pa) inlet stream throughout the reactor domain. The rise in $pO_2$ arises from increasingly oxidized $MO_x$ particles representing countercurrent flow. In this model, 2-D simulated particles release $O_2$ into flowing $N_2$, inside geometries representing the IPR, the OFR and the ZFR.

Along with high particle gas mixing, a high residence time ($\tau_R$) is essential to account for thermal, particle and diffusion kinetics. A surface level observation of the ZFR design reveals that different parameters like the angle of mesh incline, number of meshes, distance between meshes, amplitude of vibration, particle fluidization potentially impact the $\tau_R$. Thus, to get a deeper understanding into the combined effect of all these parameters this disclosure compares the $\tau_R$ in representative prototypes of the candidate reactors. A small quantity of sand particles was instantaneously added to each of the representative prototypes and the exiting particle flow was monitored with a load cell to obtain the $\tau_R$. The main objective of this analysis is to find a reactor design that can offer high residence time per unit reactor height ($\tau_{R,unit}$).

After preparing for the reaction kinetic considerations in the reactor design, a 2-D diffusion model takes a closer look at the $O_2/N_2$ diffusion in the ZFR at the scale of one particle and its effect on the reactor power density ($P_D$). The ZFR power density ($P_D$) intricately depends on the ZFR design variables like distance between the meshes ($\Delta h_{mesh}$), the number of meshes ($n_{mesh}$), $A_R$ and the particle diameter ($d_P$). The objective of the presented model at the scale of one particle model is to investigate the dependence of $\Delta pO_2$, and $P_D$ on the ZFR variables of dr and $\Delta h_{mesh}$. This will shed light on the variable limits for which the equilibrium model is valid to estimate the ZFR performance.

Considering all the model results, a laboratory prototype was tested under particle and gas flow to evaluate the ZFR performance and prove the concept. The main parameters monitored during the experiment were: (i) the temperature gradient, (ii) the $pO_2$ in the exit $N_2$ stream with an oxygen sensor (Advanced Instruments Inc. GPR-1535 GB PPM oxygen glove box transmitter), (iii) exiting particle mass flow rate with a load cell and (iv) reduction extent of the reduced sample using the weight gain from reoxidation.

Finally, the disclosure provides a CAD model for the grid scale ZFR. This scaled up design allows for the modeling of cost of construction materials required at grid scale. The objective of this model is to understand how the material costs per unit stored energy and per unit output power scale with reactor output power.

Results

Discretizing the Ideal Reaction Path into Finite Steps

Figure 4:
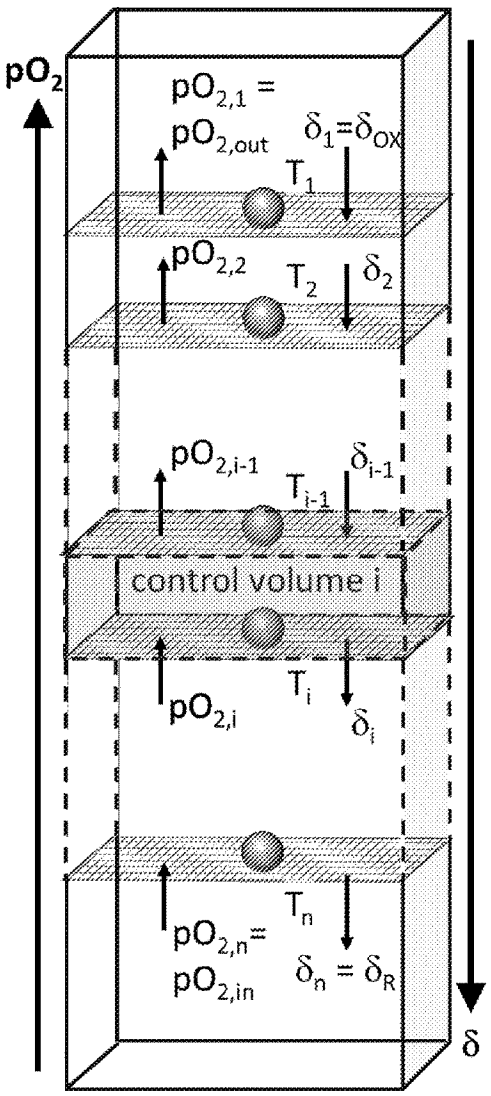
FIG. 4 shows a countercurrent flow reactor discretized in n parts showing the direction of $pO_2$ and δ increase.

FIG. 4 shows a discretized version of the path divided in n steps where n is finite. This reaction path has the following known boundary conditions: (i) the $MO_x$ input reduction extent (Sin), (ii) the $N_2$ inlet purity ($pO_{2,in}$), (iii) the temperature gradient at each step, chosen by arbitrarily dividing the temperature gradient from FIG. 2, (iv) the target output reduction extent ($\delta_{out}$) and (v) the sweep ratio ($\lambda$) described in the literature. The Eq. 2 defines k to reflect the single step TCES reduction reaction instead of the two-step W-S in the original definition. The goal of this model is to find the optimum boundary conditions for which, similar to the reactor, S increases linearly (i.e., $\delta_i$) as $pO_2$ decreases along the reaction path ($pO_{2,i}$) allowing the approach to reaction equilibrium.

$$\lambda = \frac{\dot{n}_{ISG}}{\Delta \dot{n}O} \quad \text{Eq. 2}$$

Assuming the thermal reduction of $MO_x$ as the only source of evolved $O_2$ within the control volume between the steps, Eq. 3 shows the process mass balance. In Eq. 3, $\dot{n}O_{2,i}$ and $\delta_i$ are the $O_2$ molar flow rate normalized to the $MO_x$ molar flow rate ($\dot{n}MO_x$) and the $MO_x$ reduction extent at the $i^{th}$ mesh respectively. The value of 'i' ranges from 2 to n.

$$\dot{n}O_{2,i-1} = \dot{n}o_{2,i} + \frac{1}{2}(\delta_i - \delta_{i-1}) \quad \text{Eq. 3}$$

The reaction path becomes ideal if the reactions occur at a specific reaction coordinate dependent on the material where $\Delta G \rightarrow 0$. The resulting evolved $O_2$ needs to rapidly diffuse away from the particles into the flowing $N_2$ at each reaction step. To accommodate the process kinetics, each step should offer sufficient $\tau_R$ and sufficient particle gas mixing to accommodate the finite jumps in temperature, reduction extent and $pO_2$. The distance between the steps should be sufficient for homogenizing the evolved $O_2$ along the reactor cross section to avoid local $pO_2$ gradients and inconsistent reduction. Assuming that all these conditions are satisfied, Eq. 4 determines the resulting $pO_2$ at mesh 'i−1' where $P_{ref}$ is the reference pressure (1 Bar), and $\dot{n}_{N2}$ is the molar flow rate of $N_2$ normalized to $\dot{n}MO_x$.

$$pO_{2,i-1} = P_{ref}\frac{\dot{n}O_{2,i-1}}{(\dot{n}_{N2} + \dot{n}O_{2,i-1})} \quad \text{Eq. 4}$$

Dividing by $\dot{n}_{N2}$ we get Eq. 5.

$$pO_{2,i-1} = P_{ref}\frac{\frac{\dot{n}O_{2,i-1}}{\dot{n}_{N2}}}{\left(1 + \frac{\dot{n}O_{2,i-1}}{\dot{n}_{N2}}\right)} \quad \text{Eq. 5}$$

Assuming constant temperature at each step, at equilibrium (i.e., $\Delta G=0$), knowing any two of the three variables, ($T, pO_2, \delta$) determines the third assuming a continuous $\Delta G$ function. Eq. 6 thus determines the $\delta$ at mesh 'i−1' using the equilibrium relationship $\delta = f(T, pO_2)$ for the given $MO_x$.

$$\delta_{i-1} = f(pO_{2,i-1}, T_{i-1}) \quad \text{Eq. 6}$$

Simultaneously solving Eq. 3, Eq. 5 and Eq. 6 with the known boundary conditions provides the $\delta$ and $pO_2$ at each mesh. This model thus shows that it is possible to approach reaction equilibrium in finite reaction steps if each step can accommodate the reaction and diffusion kinetics. Thus, the model emphasizes the need for high particle residence time ($\tau_R$) and high particle gas mixing at each reaction step.

Knowing about the particle S and $pO_2$ helps investigate the dependence of these reaction parameters on the energy storage density (W) according to Eq. 7 In Eq. 7 $C_{P,MO_x}$ is the $MO_x$ specific heat, $T_{in}$ and $T_{R,out}$ are the inlet and exit temperatures of $MO_x$ and $\Delta H_{TR,MO_x}$ is the molar thermal reduction enthalpy of $MO_x$. This model thus allows us to optimize the boundary conditions of the reaction path to maximize W.

$$W = C_{P,MO_x}(T_{R,out} - T_{in}) + \Delta\delta\Delta H_{TR,MO_x} \quad \text{Eq. 7}$$

Modeling the $pO_2$ Gradient in the Candidate Reactors

This section evaluates the effect of particle gas mixing using a 2-D CFD model of the candidate reactor geometries. High particle gas mixing is essential to accommodate the $O_2/N_2$ diffusion kinetics.

Figure 5A:
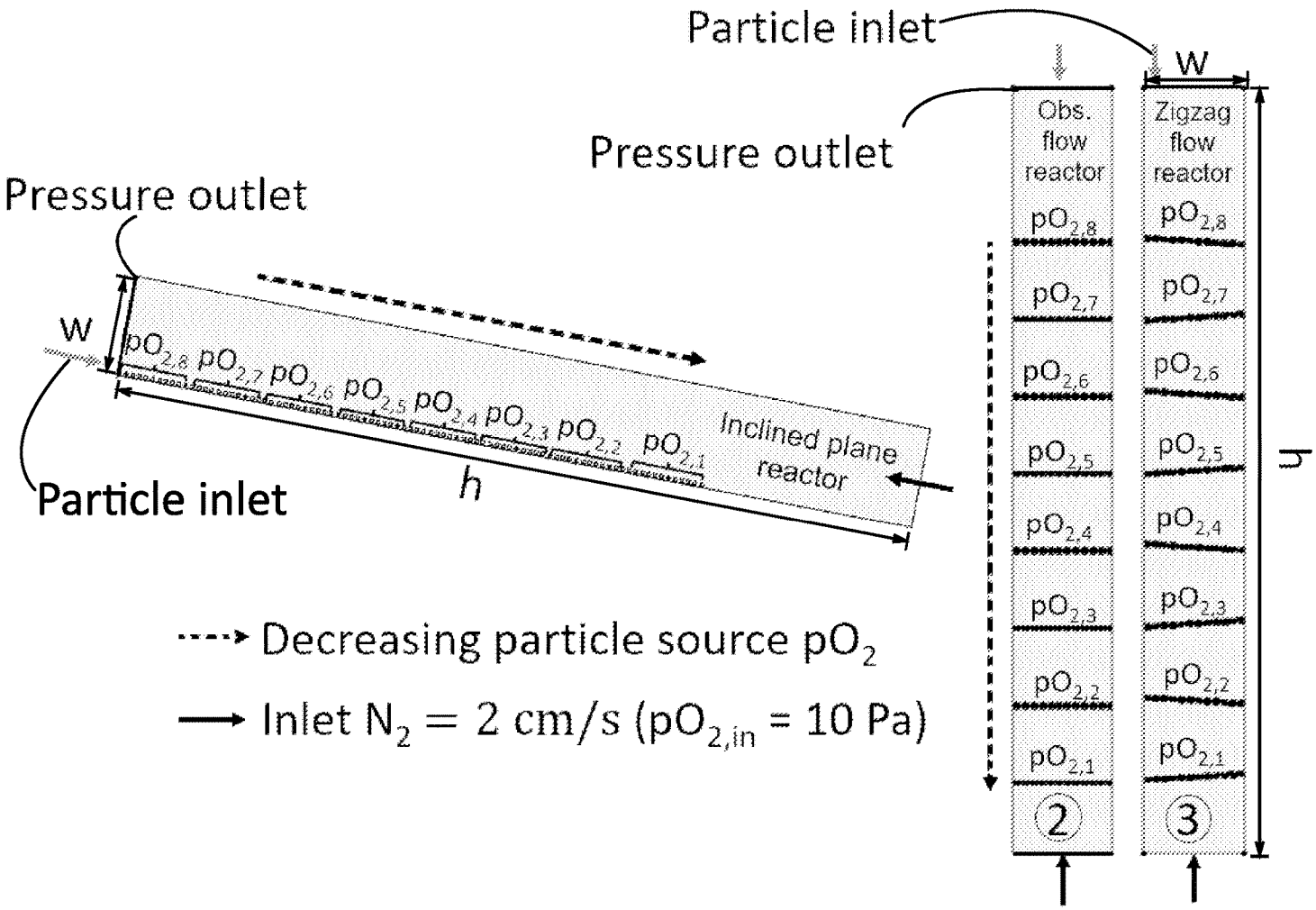
FIG. 5A shows geometry and boundary conditions for $pO_2$ gradient modeling of (1) inclined plane reactor, (2) obstructed flow reactor, (3) zigzag flow reactor.
Figure 5B:
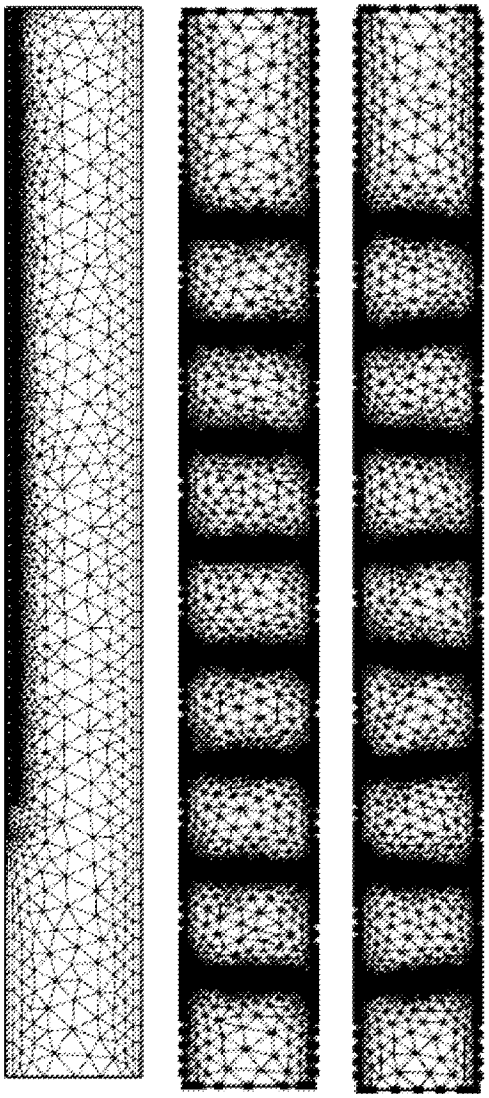
FIG. 5B shows computational mesh for flow modeling of (1) inclined plane reactor, (2) obstructed flow reactor, (3) zigzag flow reactor.

In this model, 2-D simulated particles release $O_2$ into flowing $N_2$, inside geometries representing the IPR, the OFR and the ZFR. FIG. 5A shows the geometry and boundary conditions for CFD model for the IPR, the OFR and the ZFR. The flow channel for all three cases is 300 mm×25 mm. $N_2$ enters with a velocity of 2 cm/s with a $pO_2$ of 10 Pa and exits at the pressure outlet. The model considers particles ($d_p$=500 μm), spaced by 1 mm, as stationary oxygen concentration sources. In the IPR (due to the absence of discrete steps like the OFR and the ZFR), the model assumes a group of twelve consecutive particles have the same $O_2$ source concentration. In the OFR and the ZFR, constant $O_2$ source concentration particles are located at mesh location. The angle of incline for the ZFR meshes is 5°. In a countercurrent flow reactor, $pO_2$ of the $N_2$ rises as it moves towards the exit. Thus, an arbitrarily chosen increasing function ($pO_{2,i}=10\times2^i$, i=1 to 8) simulates the oxygen potential of the $O_2$ source.

The model evaluates steady state $pO_2$ throughout each of the reactor domains. Our target is to identify a reactor design which maximizes the oxygen homogenization along the reactor cross section to prevent inconsistent Δδ. FIG. 5A (right) shows a computational mesh for the IPR, the OFR and the ZFR and Table 1 shows the corresponding computational mesh statistics. The computational mesh is refined in a way to increase the number of elements closer to the particles.

TABLE 1

Computational mesh statistics for inclined plane reactor, obstructed flow reactor and zigzag flow reactor

| ID | Number of elements | Average element quality |
|---|---|---|
| Inclined plane reactor | 11369 | 0.74 |
| Obstructed flow reactor | 18044 | 0.76 |
| Zigzag flow reactor | 17491 | 0.76 |

Effect of Particle Gas Mixing

Figure 6:
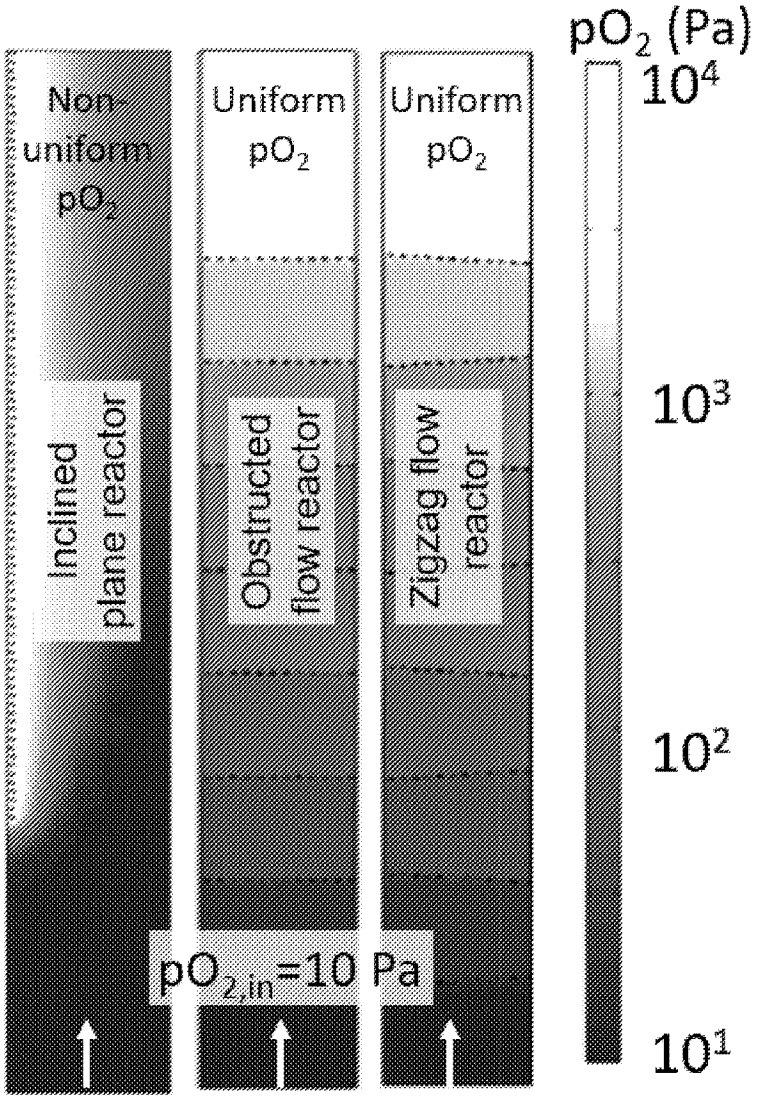
FIG. 6 presents a comparison of steady state oxygen diffusion into the flowing inert sweep gas for inclined plane reactor (IPR), zigzag flow reactor (ZFR) and obstructed flow reactor (OFR).

FIG. 6 compares the steady state oxygen diffusion into the flowing $N_2$ in each of the three candidate reactors of the IPR, the ZFR and the OFR. FIG. 6 shows that in the ZFR and the OFR, since uniform cross-sectional particles is possible, the counterflow interaction in the OFR and the counterflow-crossflow interaction in the ZFR creates significant particle gas mixing. This allows for rapid homogenization of $pO_2$ after the mesh along the reactor cross section thereby preventing uneven reduction on the subsequent mesh.

In the IPR however, particles flow along the bottom face of the reactor, due to which a $pO_2$ gradient emerges along the cross section. This $pO_2$ gradient hinders particle reduction since oxygen accumulation just above the particles increases local $pO_2$ near the particles. Further, the reduced oxygen loading into $N_2$, away from the particles, leads to significant wastage of $N_2$. This could be a potential reason for the low reduction extents observed in STInGR reactor which utilized the IPR concept. It is clear from FIG. 6 that while the OFR and ZFR offer capabilities for high particle gas mixing, the IPR offers poor particle gas mixing that can significantly decrease the particle reduction extents.

Residence Time Characteristics

This section analyzes the residence time ($\tau_R$) in the candidate geometries. A high $\tau_R$ is essential to accommodate reaction kinetics.

Since a uniform cross-sectional particle distribution is necessary, that eliminates the candidacy of the IPR for this application. The objective of this disclosure is to identify which design concept allows for simultaneously high particle gas mixing along with high $\tau_R$. Another relevant geometry worth comparing with the ZFR is the free falling particle reactor which also allows for uniform cross-sectional particle distribution.

Figure 7:
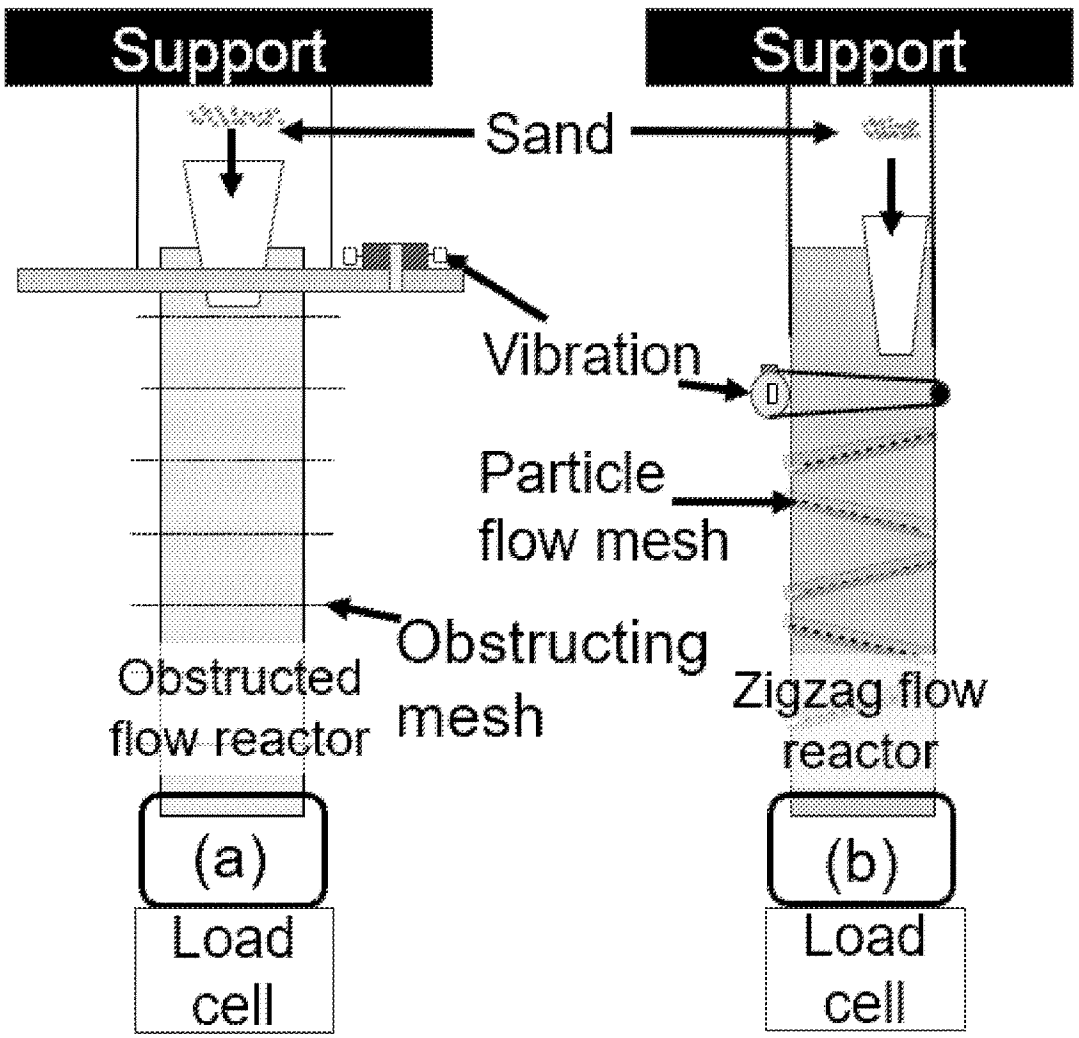
FIG. 7 presents schematics of the $\tau_R$ prototypes of (a) Obstructed flow reactor (b) Zigzag flow reactor.

FIG. 7 thus shows the schematics of the $\tau_R$ prototypes of the OFR and the ZFR. In the OFR prototype, particles fall through a vertical channel (300 mm long) while eight vertically stacked metal meshes (300 μm, 53% open area) obstruct the particle free fall and increase $\tau_R$. The channel hangs from a metal wire connected to a fixed support.

In the ZFR prototype, particles flowed along eight vertically stacked slightly inclined (~10°) particle opaque metal meshes (50 μm, 43% open area). A vibration motor enabled the particle flow in each of the prototypes. In the experiment, a small amount (5 g) of sand particles (d<250 μm) was instantaneously added to each of the prototype. A load cell placed at the exit of each prototype recorded the exiting mass flow. The parameter $\tau_{R,unit}$, which is the time taken by the first particles to exit the reactor per unit reactor height characterizes the $\tau_R$ in the three geometries of the ZFR, the OFR and the free falling particle reactor.

Residence Time in the Candidate Geometries

Figure 8:
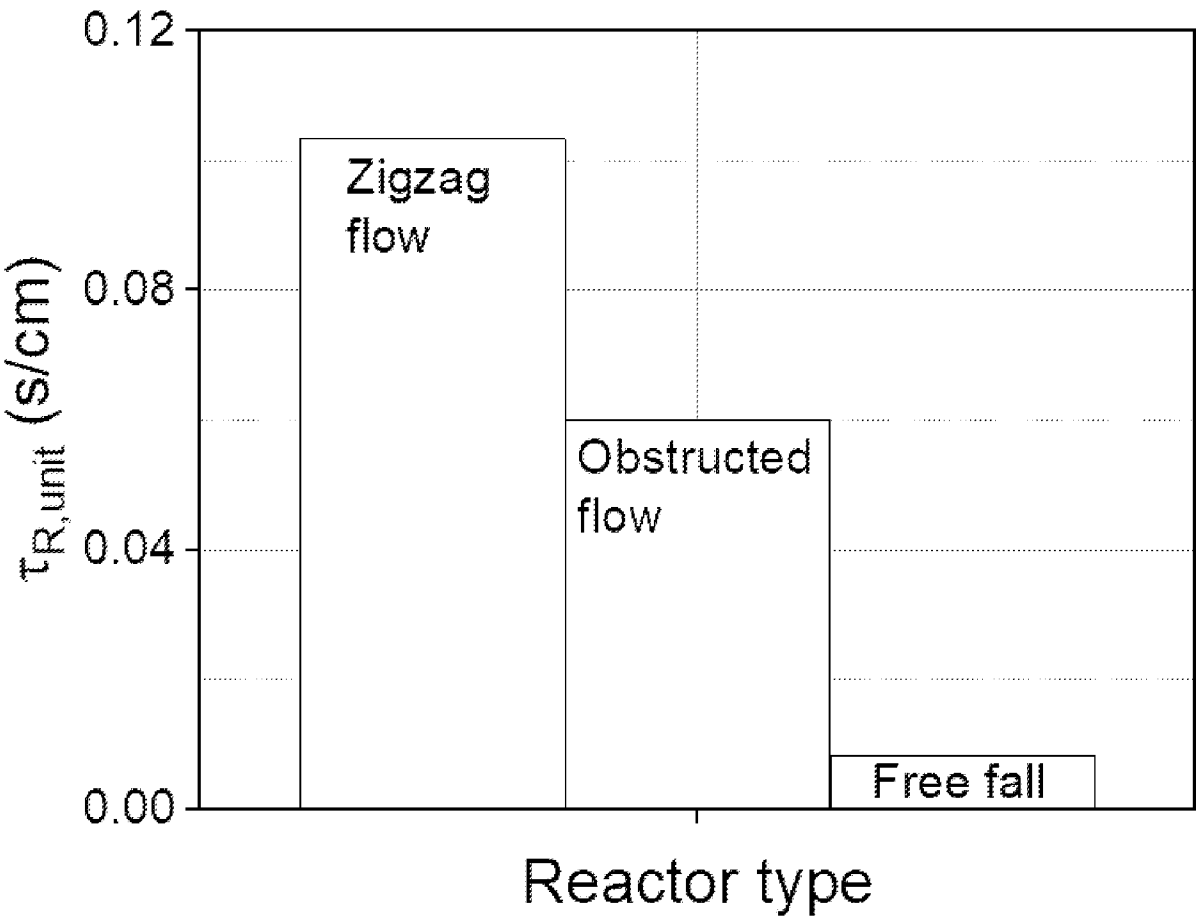
FIG. 8 shows minimum residence time per unit reactor height for inclined plane reactor (IPR).

FIG. 8 shows the $\tau_{R,unit}$ in the ZFR, the OFR and free falling reactor. FIG. 8 shows that the $\tau_{R,unit}$ for the ZFR is highest followed by the OFR and the free falling reactor. The $\tau_{R,unit}$ is highest in the ZFR because of the significantly increased path length resulting from the vertically stacked inclined mesh setup. The $\tau_{R,unit}$ in the OFR, approximately half of the ZFR, is a result of the little obstruction to the free fall experienced by particles whose diameter is much smaller than the mesh opening size. The ZFR increases $\tau_{R,unit}$ by ~15 times compared to the free falling reactor. The results show that only the ZFR offer enough residence time and particle gas mixing at each reaction step to approach reaction equilibrium. The ZFR thus represents a practical approximation of the theoretical discretized countercurrent flow reactor described in the earlier models.

Predicted Performance in a Discretized Countercurrent Flow Reactor

The CFD models and experiments ensure that the ZFR meets the necessary requirements to approach reaction equilibrium. Due to this, the predictions of the discretized equilibrium model accurately reflect the outputs of the ZFR. This section seeks to identify the likely optimal combination of reaction parameters that allow the maximization of W.

Figure 9:
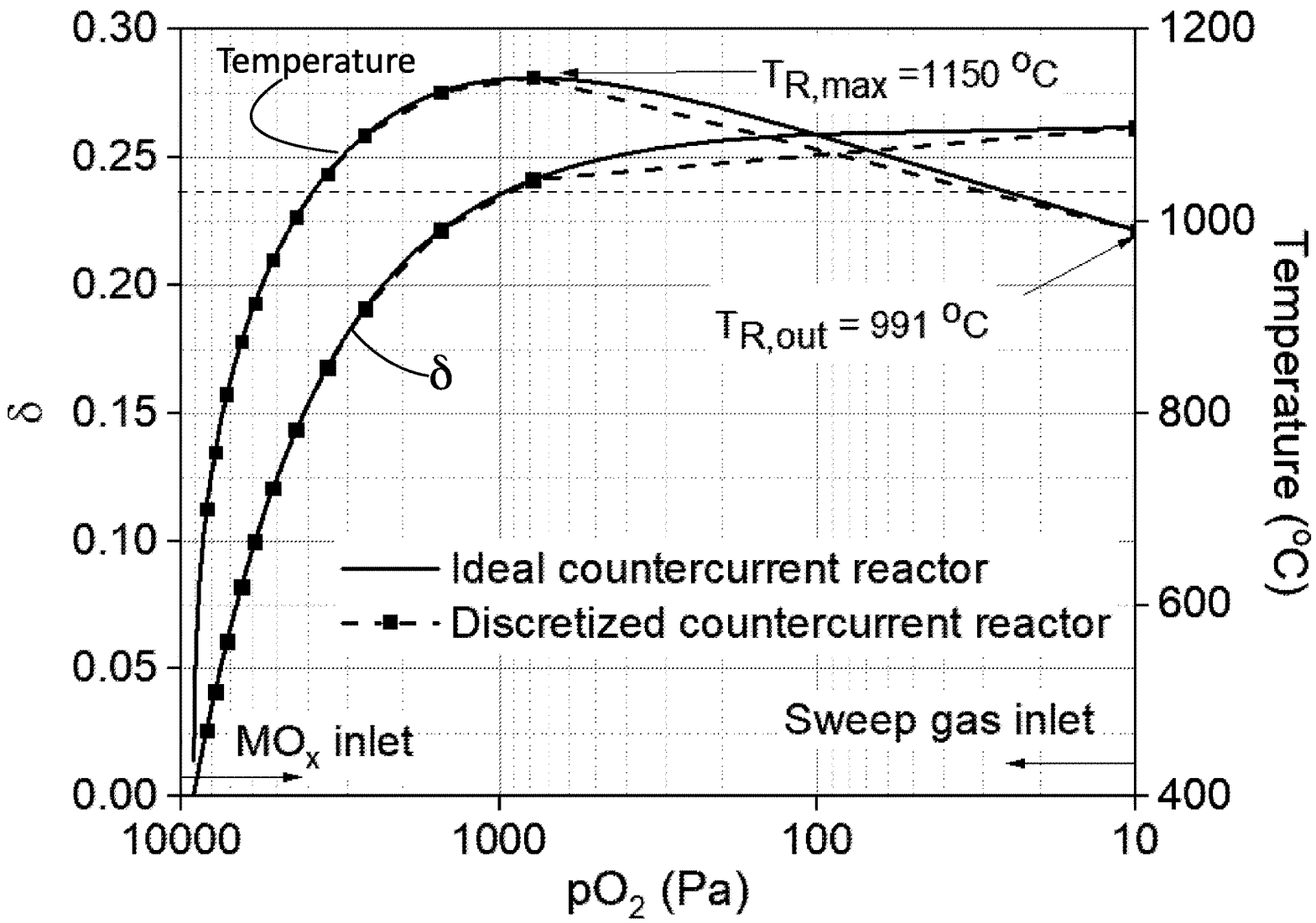
FIG. 9 presents an example of ideal and real T-$pO_2$-δ at equilibrium condition in a countercurrent reactor.

For this analysis, first consider an arbitrarily chosen ideal equilibrium temperature gradient from FIG. 9. This temperature gradient is discretized into twelve parts representing the discrete temperature gradient. This arbitrarily chosen temperature gradient has a maximum reduction temperature ($T_{R,max}$) of 1150 °C. Thus, for an initial reduction extent ($\delta_{in}$)=0.001, λ=5 and the $N_2$ purity ($pO_{2,in}$)=10 Pa, FIG. 9 further shows the predicted S at each step (mesh for the ZFR) for CAM28 particles. The δ rapidly increases initially at high $pO_2$ (>1000 Pa) and then reaches the equilibrium value at the reactor exit. It is noteworthy that from $T_{R,max}$ (1150 °C) to the reactor output temperature ($T_{R,out}$=991 °C), the δ increases by only 8% of the final value. This decrease in particle temperature to increase δ indicates an optimization of the sensible and chemical portions of the total stored energy.

Dependence of Energy Storage on Reaction Parameters

In view of our first goal, this section analyzes the dependence of W on key reaction parameters. This analysis assumes reaction equilibrium since it is valid in the context of the ZFR as demonstrated earlier. The parameters chosen in this analysis reflect the ultimate goal of reducing the LCOS. The primary reaction parameters expected to affect the costs are: (i) maximum reaction temperature ($T_{R,max}$) and output temperature ($T_{R,out}$) (ii) $N_2$ purity ($pO_{2,in}$), (iii) output reduction extent ($\delta_{out}$). The expected relationships between the chosen factors and the ZFR costs are:

- material costs for reactor and storage increase with $T_{R,max}$ and $T_{R,out}$.
- inert sweep ($N_2$) purity increases cost.
- an increase in $\delta_{out}$ (chemical storage) decreases the need for a high $T_{R,out}$ (sensible storage), which decreases the storage costs, for a constant target W.

Figure 10:
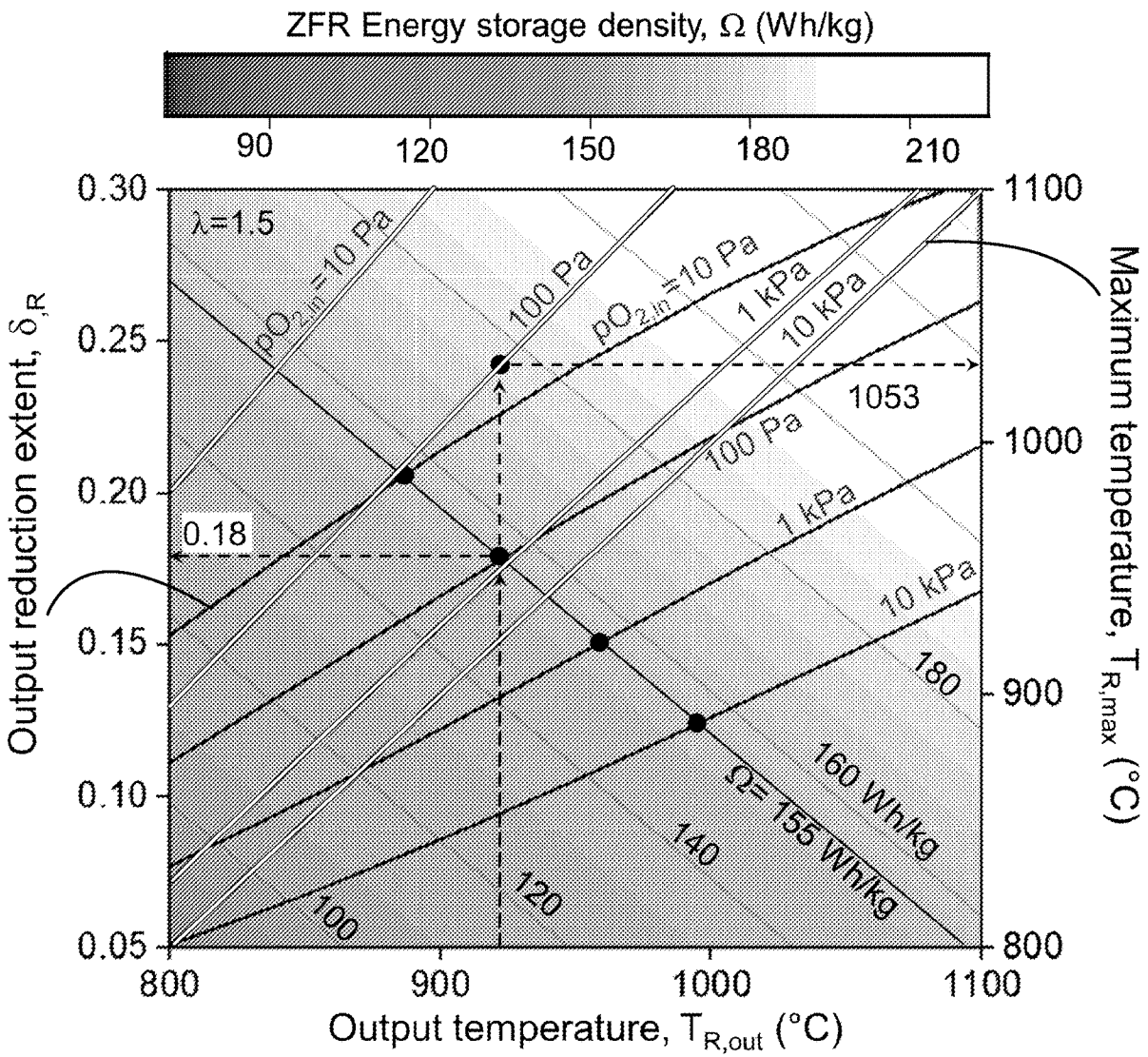
FIG. 10 shows dependence of output reduction extent and maximum thermal reduction temperature on reactor output temperature at varying values of $pO_{2,in}$ for λ=1.5. Contours represent the output energy storage density for the respective $\delta_{out}$ and $T_{R,out}$.

FIG. 10 shows the dependence of W on the selected cost parameters. The calculation of W (Eq. 7) assumes a $T_{R,min}$ of 55 0°C and $\lambda$=1.5, a more realistic assumption (compared to $\lambda$=1.5 from FIG. 9) considering the cost of using $N_2$. In FIG. 10, the $\delta_{out}$ increases with an increase in $T_{R,out}$ at constant $pO_{2,in}$ values. The W increases with an increase in $\delta_{out}$ and $T_{R,out}$ due to the increased sensible and chemical energy stored as a result. The $T_{R,max}$ decreases with increasing $pO_{2,in}$ at constant $T_{R,out}$. Notably though, there is a significant reduction in $T_{R,max}$ with increase in $pO_{2,in}$ from 10 Pa to 1000 Pa. But very little decrease in $T_{R,max}$ takes place beyond this point since $T_{R,exit}$ is only slightly smaller than $T_{R,max}$ at $pO_{2,in}$=1000 Pa. The experimental point (described in later sections) lies at the lower end of $T_{R,out}$ in this initial attempt.

To understand how this result affects costs, consider a case where the target W for the ZFR of 155 Wh/kg. In FIG. 10, every point on the W=155 Wh/kg line represents a unique combination of factors that achieve the target W. Consider four such points, one for each intersection of the W=155 Wh/kg line with $\delta_{out}$ vs. $T_{R,out}$ lines at constant $pO_{2,in}$ (Table 2). Table 2 shows that, though the $pO_{2,in}$=10 Pa case offers the best $T_{R,out}$ and $\delta_{out}$ making the storage less costly, it has the worst $pO_{2,in}$ and $T_{R,max}$ thus increasing the reactor costs and $N_2$ costs. On the other end, $pO_{2,in}$=10 kPa offers the best case for the reactor construction and $N_2$ use costs but higher storage costs. For $pO_{2,in}$=1 kPa case, $pO_{2,in}$ is hundredfold higher than the worst case (10 Pa) with the potential for $N_2$ cost savings. The $pO_{2,in}$=1 kPa case also has the lowest $T_{R,max}$ and moderately high $T_{R,out}$. But while $T_{R,out}$ is only 70 °C higher than best case, $T_{R,max}$ drops by >200 °C than the worst case. All these benefits point to $pO_{2,in}$=1 kPa as the likely optimum combination of factors to minimize overall costs.

TABLE 2

Four combination of reactor parameters that achieve 155 Wh/kg. best, worst, optimum.

| $pO_{2,in}$ (Pa) | $T_{R,out}$ (° C.) | $\delta_{out}$ | $T_{R,max}$ (° C.) |
|---|---|---|---|
| 10 | 890 | 0.21 | 1,092 |
| 100 | 926 | 0.18 | 1,053 |
| 1k | 960 | 0.15 | 986 |
| 10k | 995 | 0.12 | 995 |

$pO_{2,in}$=1 kPa case brings the ZFR in the temperature range of common stainless steel grades e.g., 309 or 310. These grades are significantly less costly (retail price \$~3-\$9/kg) than SS330 or Inconel 625 (retail price \$23-\$43) required for 1100 °C of the worst case. Storage costs on the other hand do not change much, going from the best case i.e., $T_{R,out}$=890 °C to this case, 960 °C where SS309 and 310 are still applicable. Finally, the $\delta_{out}$ for 1 kPa case (0.15), though lower than the best case (0.21), still meets the target W, thus not being as important as $T_{R,out}$ in overall costs. The above results offer an alternative to the commonly held assumption in the thermochemical community that $N_2$ purity, reaction temperatures, and $\Delta\delta$ must all be maximized in thermochemical energy storage.

Components of the Total Stored Energy

Figure 11A:
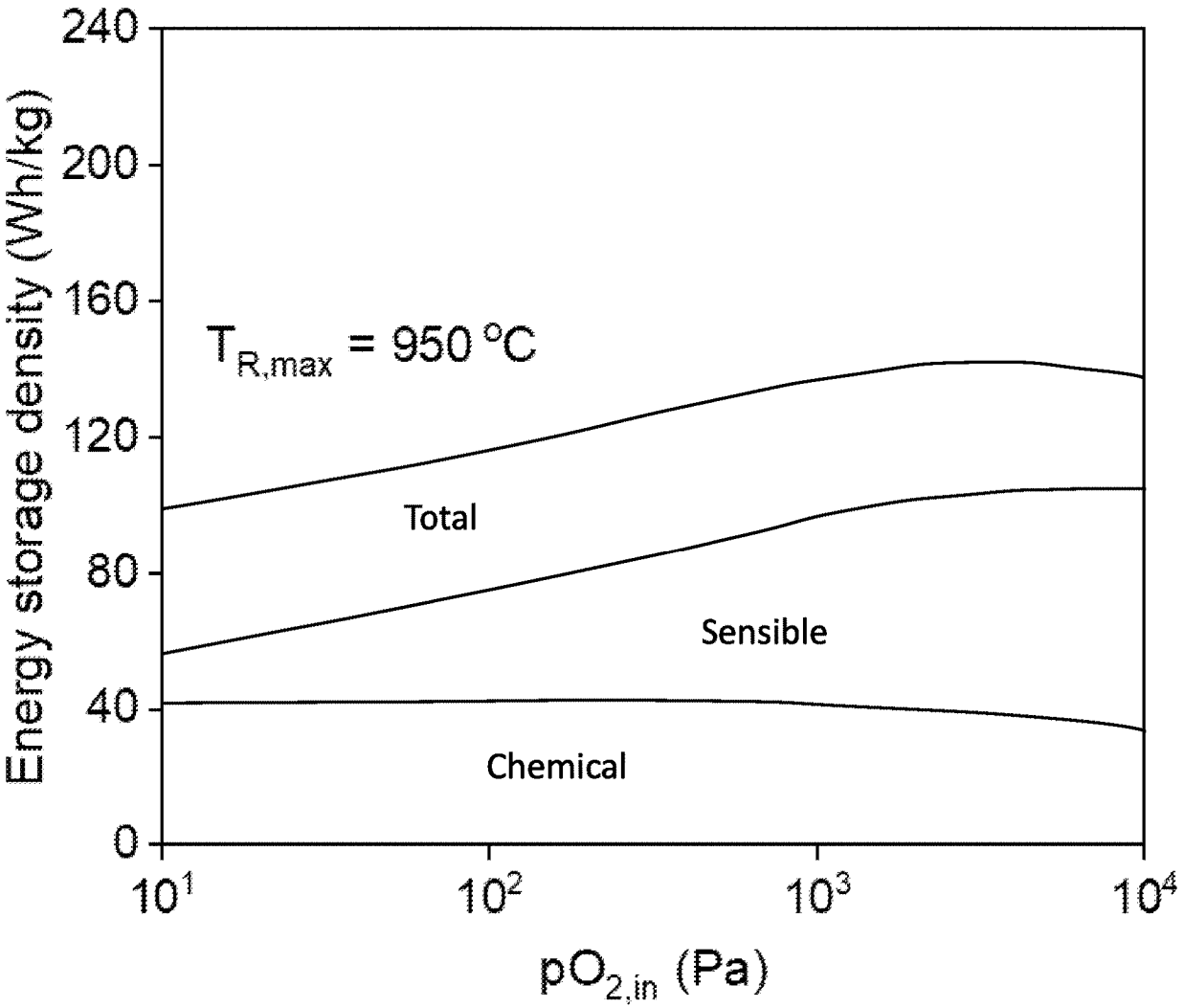
FIGS. 11A and 11B show dependence of chemical energy storage density, sensible energy storage density and total energy storage density on $pO_{2,in}$ at a constant $T_{R,max}$=950 °C (Left); $T_{R,max}$=1100 °C (Right) for λ=1.5
Figure 11B:
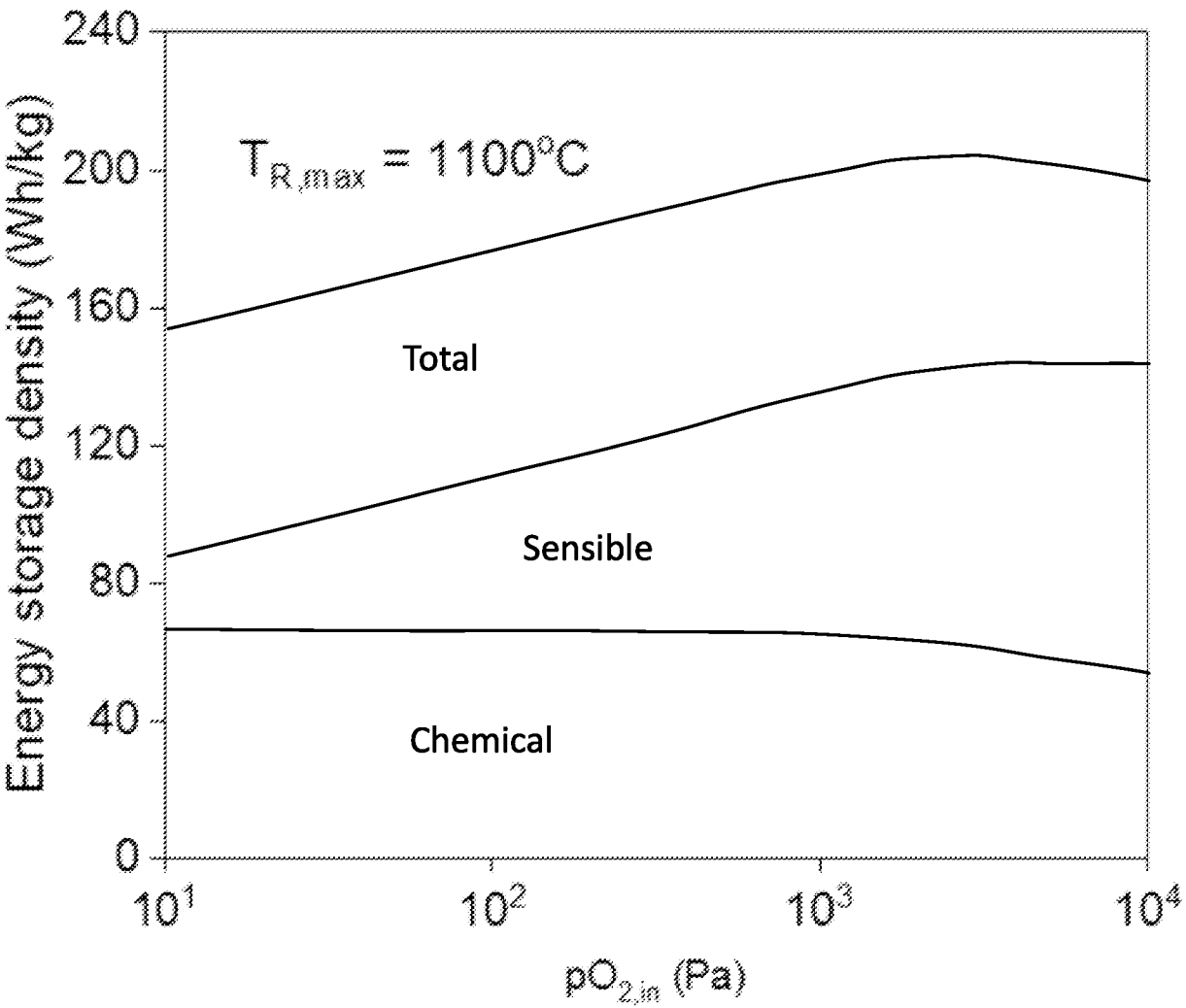

In the second analysis, the disclosure analyzes the change in W with change in $N_2$ purity ($pO_{2,in}$) by fixing the maximum reduction temperature ($T_{R,max}$) at 950 °C and 1100 °C Further, the analysis seeks the relative contributions of sensible and chemical portions to the total stored energy (FIG. 11). In FIG. 11, the chemical energy storage density decreases with increase in $pO_{2,in}$ as $\delta$ decreases. But the sensible energy storage density increases with increase in $pO_{2,in}$ as the $T_{R,exit}$ increases up to a $pO_{2,in}$ of ~2000-4000 Pa and then becomes constant as $T_{R,exit}$ approaches $T_{R,max}$. However, the sensible portion increases much faster than chemical leading to an overall increase in W until the $T_{R,out}$ reaches its maxima. Once, the sensible portion peaks, further increase in $pO_{2,in}$ leads to a decrease in W since the chemical portion continues to decrease with $\delta$. Increasing the $T_{R,max}$ from 950 °C to 1100 °C increases all the storage densities but the peak of W moves to a lower $pO_{2,in}$. For both the cases of $T_{R,max}$ of 950 °C and 1100 °C, F lies within 1% of the peak over a range of ~2000 Pa to ~6000 Pa. However, W peaks at ~1600 Pa for $T_{R,max}$=1150 °C and at ~3500° Pa for $T_{R,max}$=950 °C A tradeoff should thus be considered between reactor heating costs (for increasing $T_{R,max}$) and cost of using $N_2$ (for decreasing $pO_{2,in}$).

Model for Countercurrent Flow Reactor

1. Reduction Reactor Mass Transfer

The equilibrium model is independent of any specific reactor and is only an analysis of the reaction path. The reactor size is primarily dependent on the $O_2$—$N_2$ diffusion parameters and scaling costs. Therefore, this chapter provide two analytical models: (i) Model to characterize the $O_2$—$N_2$ diffusion at the particle-scale and its effect on the reactor size and power density (ii) Numerical model verification of the mass transfer model trends.

2. Mass Transfer Model Description 2.1 Local Particle Environment

After understanding the physical requirements to approach chemical equilibrium along a discrete reaction path, this section provides a mass transfer model to estimate the $O_2$—$N_2$ diffusion characteristics at a reactor location where the particles and gas interact. Interestingly, $\Delta pO_2$ between the particle surface and its surroundings ($pO_2$,surf-$pO_2$) is a measure of $O_2$—$N_2$ mixing. $\Delta pO_2$=0 indicates transverse gas homogeneity. The following analysis models the dependence of $O_2$—$N_2$ mass transfer parameters on the reactor and particle dimensions. Reactor dimensions also determine $\Pi$, a key cost parameter.

Figure 12:
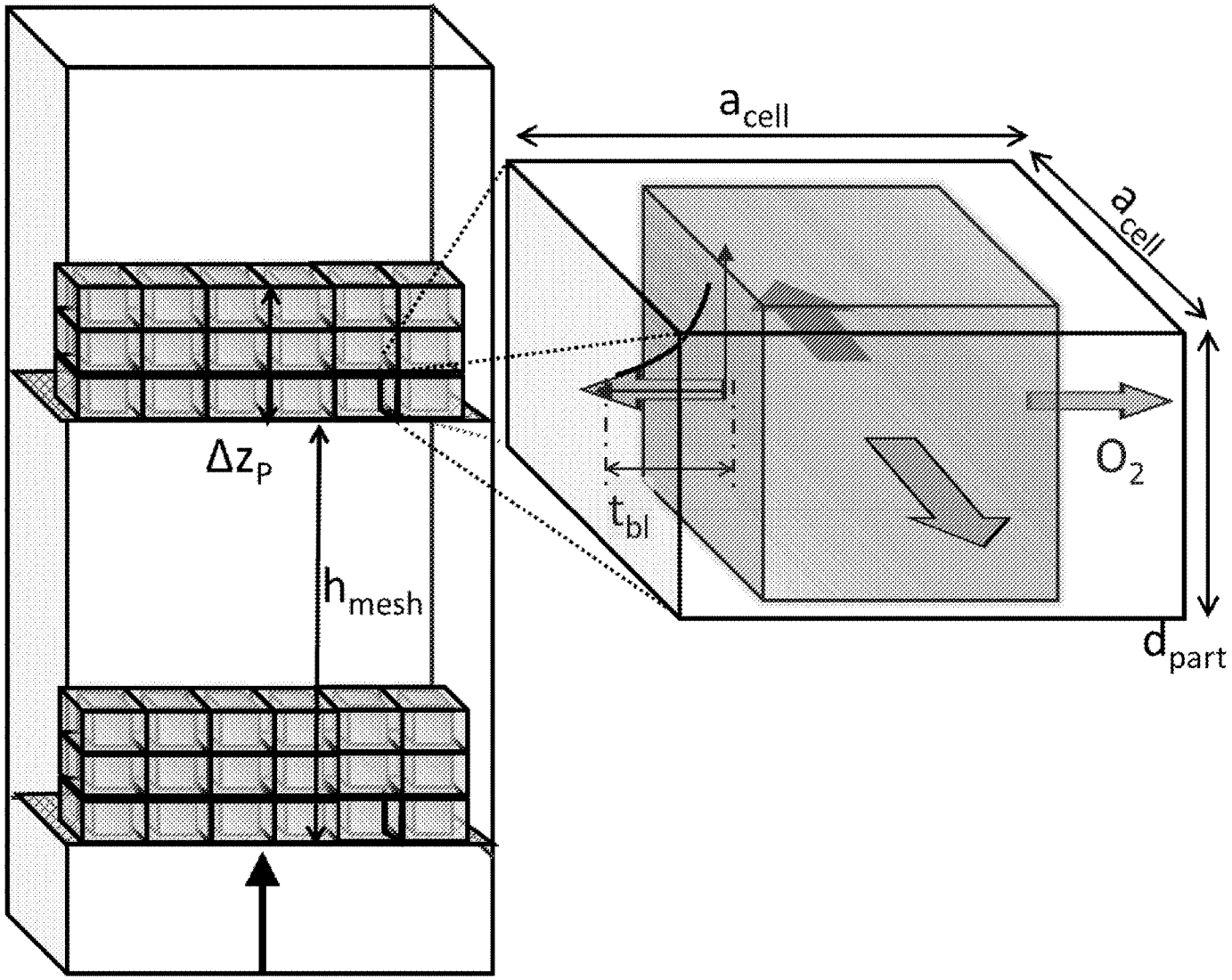
FIG. 12 shows Schematic Of O2 N2 Laminar Diffusion In the ZFR and 3D View Of The Particle Unit Cell.

FIG. 12 shows the local particle environment as a small unit cell, assuming equal volumetric division among identical cubic particles. This analysis assumes that all $O_2$ evolves perpendicular to the $N_2$ flow. Multiple layers of particles create a particle bed of thickness $\Delta z_{part}$.

3. Model Formation

The $O_2$ evolved from one particle at the reaction, where $n_{MO_x,P}$ is the number of moles of $MO_x$ per particle is:

$$\dot{n}_{O_2,P} = n_{MO_x,P}\frac{\Delta\delta}{2\tau_R} \quad \text{Eq. 8}$$

The resulting concentration boundary layer thickness ($t_{BL}$) at an entry length ($L_e$) is $$t_{BL} = \left( \frac{4.91 L_e}{\frac{\sqrt{2 * Re_z}}{Sc^{\frac{1}{3}}}} \right)^{2/3} \quad \text{Eq. 9}$$

where Sc is the Schmidt number. The resulting Sherwood number for the particle (Sh) is $$Sh = 0.664 Re_z^{\frac{1}{2}} Sc^{\frac{1}{3}} \quad \text{Eq. 10}$$

The particle mass transfer coefficient ($h_{mass}$) then results from Sh, the $O_2$—$N_2$ diffusivity ($D_{O_2\text{-}N_2}$) and the particle characteristic length ($L_C$), $$h_{mass} = \frac{Sh D_{O_2-N_2}}{L_C} \quad \text{Eq. 11}$$

The $\Delta pO_2$ required to enable this mass transfer to occur is then, $$\Delta pO_2 = \frac{j_{O_2}}{h_{mass} RT} \quad \text{Eq. 12}$$

where $j_{O_2}$ is the $O_2$ molar flux. The number of such particles that can exist in one layer of a reactor of hydraulic diameter ($D_h$) is:

$$N_{P,layer} = \pi \frac{D_h^2}{A_{cell}} \quad \text{Eq. 13}$$

where $A_{cell}$ is the area of the unit cell, normal to the $N_2$ flow, such that $a_{cell}=2t_{BL}+d_{part}$ and $A_{cell}=a_{cell}^2$. The $pO_2$ of the $N_2$ stream after the reaction step then becomes $$pO_{2,out} = pO_{2,in} + \frac{P_{ref} j_{O_2}}{j_{N_2} + j_{O_2}} N_{layer} \quad \text{Eq. 14}$$

where $j_{N_2}$ is the $N_2$ molar flux and $N_{layer}$ is the number of particle layers on the reaction step. The thickness of such a particle bed is then $$\Delta z_P = \frac{D_h^2}{d_p N_{P,layer}} \quad \text{Eq. 15}$$

Assuming that the distance between two successive steps, $h_{mesh}=10\Delta z_p$ to allow further gas mixing and homogenization. The power density of this reactor (I) is then:

$$\Pi = \frac{j_{MO_x}(c_{P,MO_x}\Delta T + \Delta\delta\Delta h)}{h_{mesh}} \quad \text{Eq. 16}$$

Figure 13:
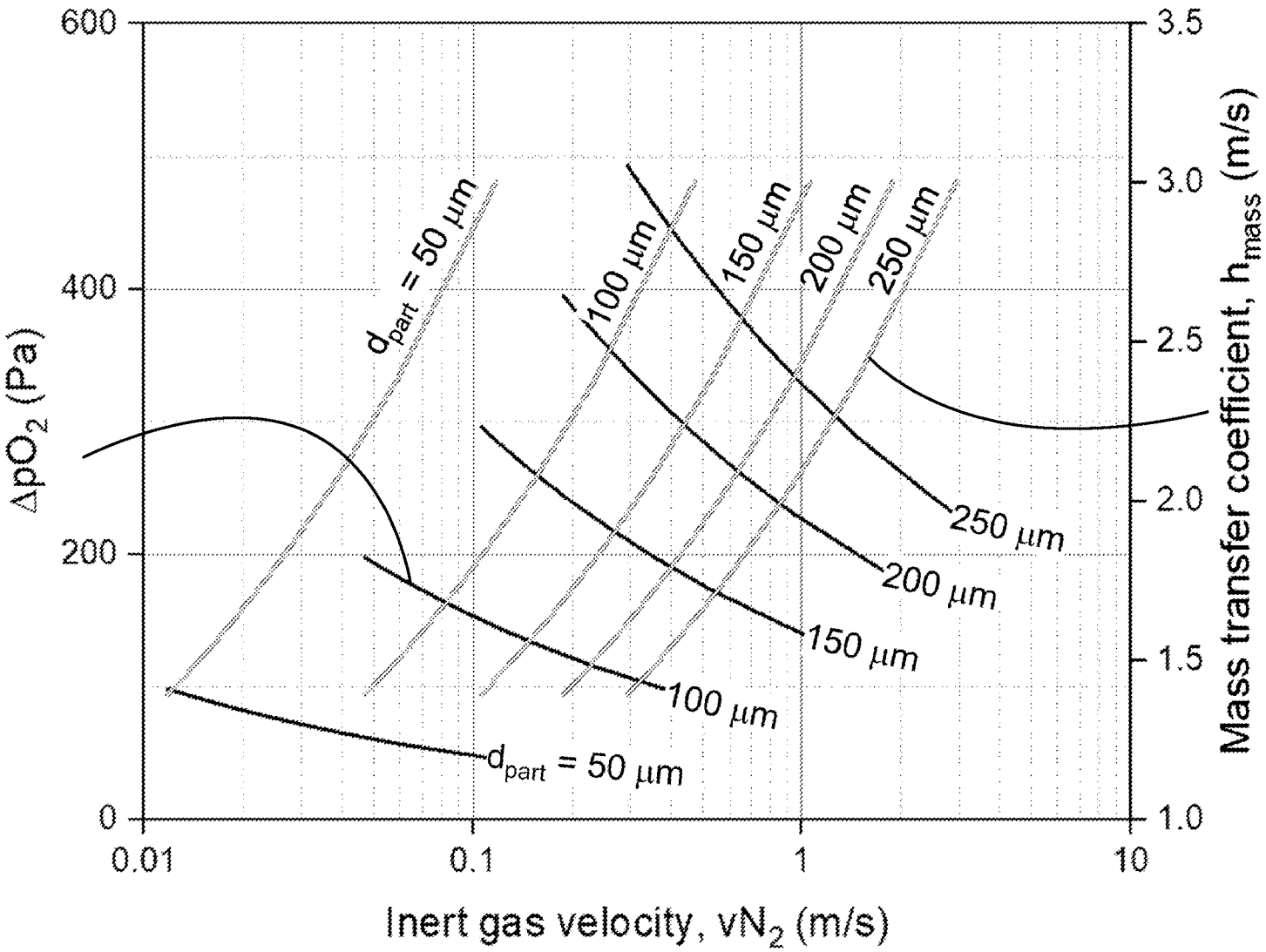
FIG. 13 shows dependence Of $\Delta pO_2$ and the mass transfer coefficient, $h_{mass}$ on the inert gas velocity ($vN_2$) at different particle diameters ($d_{part}$).

3.1 Results 3.1.1 Analysis of the Difference in Oxygen Partial Pressure Between the Particle Surface and its Surroundings This section elucidates the important results of the analytical mass transfer model. The objective here is to identify cost tradeoffs similar to the equilibrium model. Inert gas velocity ($vN_2$) is a vital parameter for reactor design since it determines the required $N_2$ volume and cost. Here, CAM28 as the metal oxide of choice, $D_h$=0.01 m, $d_{part}$=200 μm, $\tau_R$=1.5 s and T=1000 C and $\Delta\delta$=0.02. According to FIG. 13, $\Delta pO_2$ decreases with increase in inert gas velocity because $h_{mass}$ increases. With an increase in $vN_2$, the Reynolds number increases which increases $h_{mass}$ and therefore, the same amount of evolved $O_2$ can diffuse through the $N_2$ stream with a much lower $\Delta pO_2$. The $vN_2$ is restricted by the terminal velocity ($v_T$) of the respective particles. In FIG. 13, $h_{mass}$ is independent of $d_{part}$ since the Reynold's number increases with increase in $d_{part}$ thereby nullifying the effect of $d_{part}$ increase. At a constant $d_{part}$, $h_{mass}$ increases with $vN_2$ because of the increase in Reynold's number.

3.1.2 Reactor Sizing and Power Density

The next two crucial parameters under investigation in this study are as follows: (i) $\Delta z_p$, which holds significance as it determines the spacing between consecutive steps, denoted as $h_{mesh}=10\Delta z_p$. This value enables the estimation of the reactor power density and (ii) The packing fraction, represented as $f_p=d_{part}/a_{cell}$, is another key parameter of interest. It plays a pivotal role in determining $N_{P,layer}$, thus shedding light on the particle conveyance capabilities during the reaction step.

Figure 14:
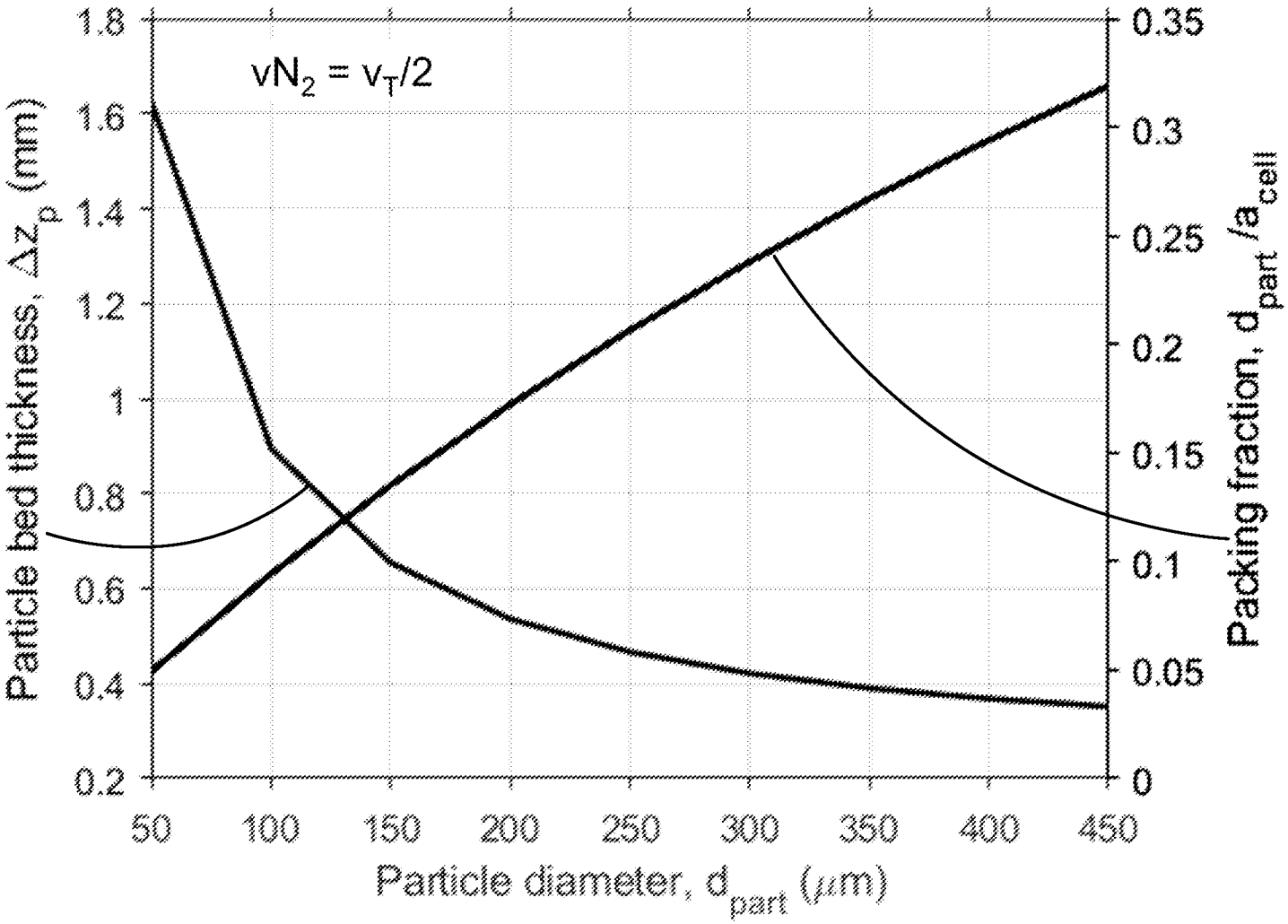
FIG. 14 shows particle bed thickness $\Delta z_p$ and Packing Fraction, $d_{part}/a_{cell}$ as a function Of particle diameter, $d_{par}$.

As illustrated in FIG. 14, $\Delta z_p$ exhibits a decreasing trend with an increase in $d_{part}$, especially when $vN_2=v_T/2$. This phenomenon occurs because $n_{MO_x,P}$ increases with increasing $d_{part}$, reducing the number of layers required to maintain the same $MO_x$ flow rate- an element solely dependent on $vN_2$. Moreover, FIG. 14 also indicates that $f_p$ experiences an increase with the augmentation of $d_{part}$. In the context of larger $d_{part}$ values, the increased $vN_2$ requires smaller unit cells to accommodate the resulting smaller boundary layers effectively.

Figure 15:
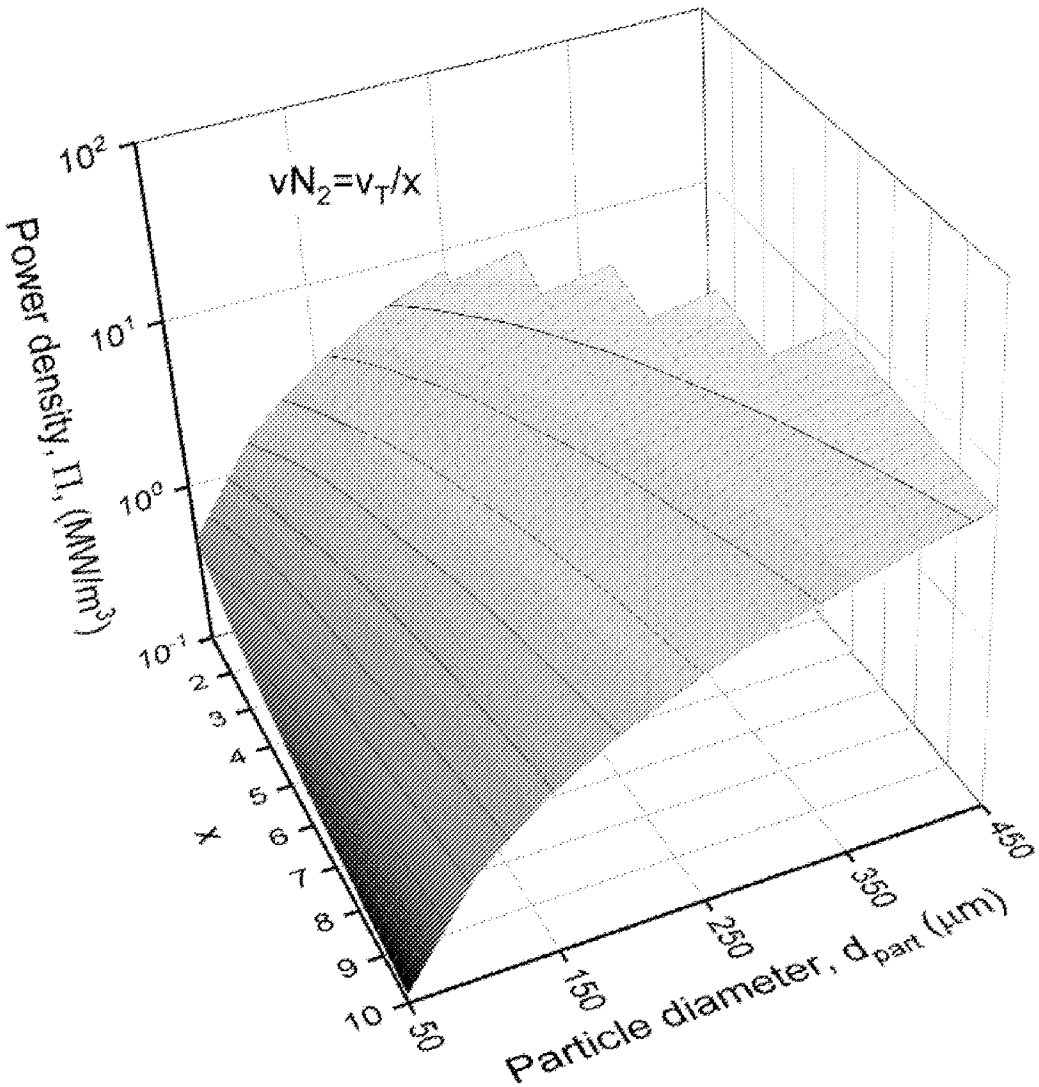
FIG. 15 presents dependence of power density (Π) on the particle diameter as a function of inlet gas velocity.

Finally, FIG. 15 shows the reactor power density (H) as a function of $d_{part}$ and $vN_2=v_T/x$, where x=1 to 10. According to FIG. 15, H increases with increase in $d_{part}$ as well as $vN_2$. Expectedly then, in the selected parameter range, Π maximizes at ~8.9 MW/m$^3$ for $d_{part}$=300 μm and x=1.4, i.e., $vN_2$=3.025 m/s. Therefore, there exists a tradeoff maintaining a small $\Delta pO_2/pO_{2,out}$ which improves equilibrium proximity and increasing H which reduces the reactor size to minimize overall costs.

Proof of Concept Prototype

Figure 16:
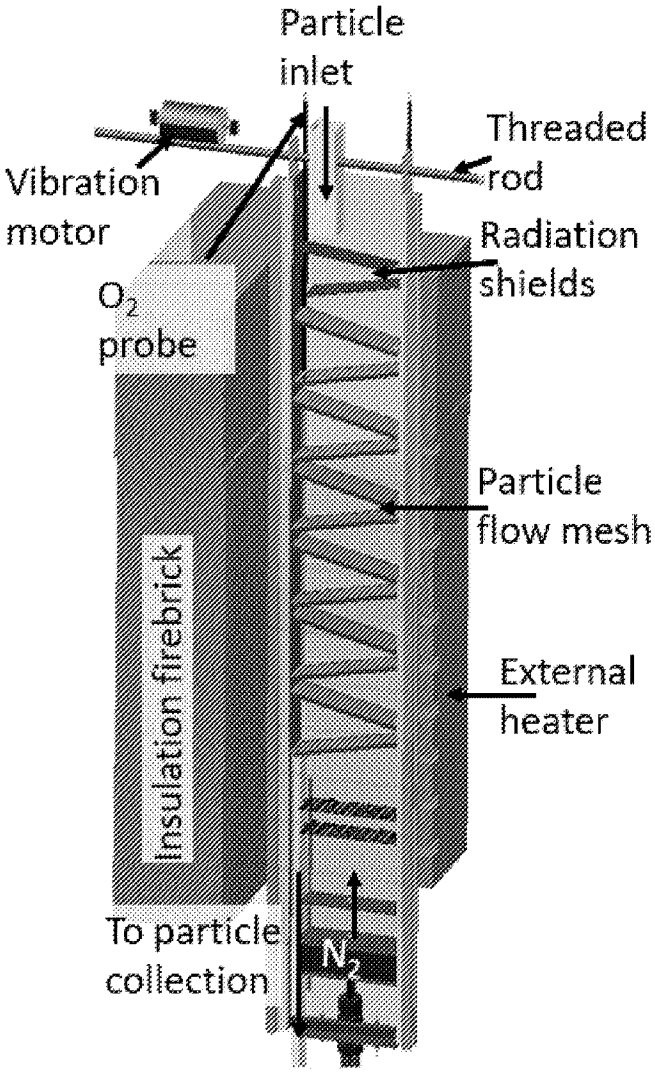
FIG. 16 shows (a) mass supply rate; (b) measured reactor exit mass flow rate and measured exit $pO_2$ as function of time.

After modeling and prototyping different reactor geometries, it is important to manufacture the conceptual design to prove the concept. This section thus contains details of the laboratory prototype created to understand the ZFR operation. For a steady state operation under particle and $N_2$ flow, the ZFR requires more than just the flow channel to operate. Thus, multiple subsystems designed around the ZFR particle flow channel allow it to operate uninterrupted for a long time. FIG. 16 shows the CAD model of the ZFR laboratory prototype.

The reaction occurs inside a 75 mm×25 mm×600 mm SS304 u-channel with flared seams to which the 12 SS 304 meshes are spotwelded in place at an inclination of ~15°. The channel hangs off a fixed 6.25 mm diameter SS 304 threaded rod, which also carries the vibration motor to enable particle flow. The particle flow mesh opening diameter in the particle-opaque portion is 50 μm with 41% open area (for $d_{part}$=50-100 μm). The particle-transparent portion contains a 200 μm mesh. The particles flow along a zigzag pattern of the meshes while $N_2$ coming from the sparger (inlet $pO_2$=17 Pa), moves vertically through the gas transparent meshes with little pressure drop. Resistance heaters embedded in firebrick heat the cavity of CAM28 and $N_2$, from outside, to a temperature of 900 °C±10 C. The particles exit the flow channel through the particle chute. A fan rapidly cools the particles in the chute below the reoxidation temperature (~500 °C) to minimize reoxidation after the particle exit. The chute delivers the particles to the particle collection chamber. A load cell under the particle collection chamber monitors the exiting particle flow.

A secondary stream of buffer gas prevents further reoxidation in the particle collection chamber. A mass flow controller, factory calibrated to within ±0.6%, supplies the $N_2$ to the flow channel. A $O_2$ probe leading to an oxygen sensor sucks out a small sample (200 sccm) of the $N_2$ flow near the 0 to measure the $O_2$ concentration in the exit gas stream. The oxygen sensor is calibrated to within +1% of the full scale $pO_2$ range (0-25%).

A small sample (~20 g) of the reduced particles from the particle collection chamber is then reoxidized it at 620 °C temperature for 30 mins. This reoxidation leads to increase in the sample weight as the $O_2$ removed during the particle reduction re-enters the $MO_x$ lattice. We use this weight gain to gravimetrically determine the Δδ for the experiment according to EQ. 17. In EQ. 17, $m_{MOx,out}$ and $m_{MOx,in}$ are the sample weights before and after reoxidation, MWo is the molecular weight of oxygen atom and $MW_{MOx}$ is the molecular weight of the $MO_x$. $f_{reac}$ is the fraction of $MO_x$ particles that are reactive.

$$\Delta\delta = \frac{\dfrac{m_{MOx,in} - m_{MOx,out}}{m_{MOx,in}}}{f_{reac}\dfrac{MW_O}{MW_{Mo_x}}} \quad \text{Eq. 17}$$

Typical Reactor Operation

Figure 17A:
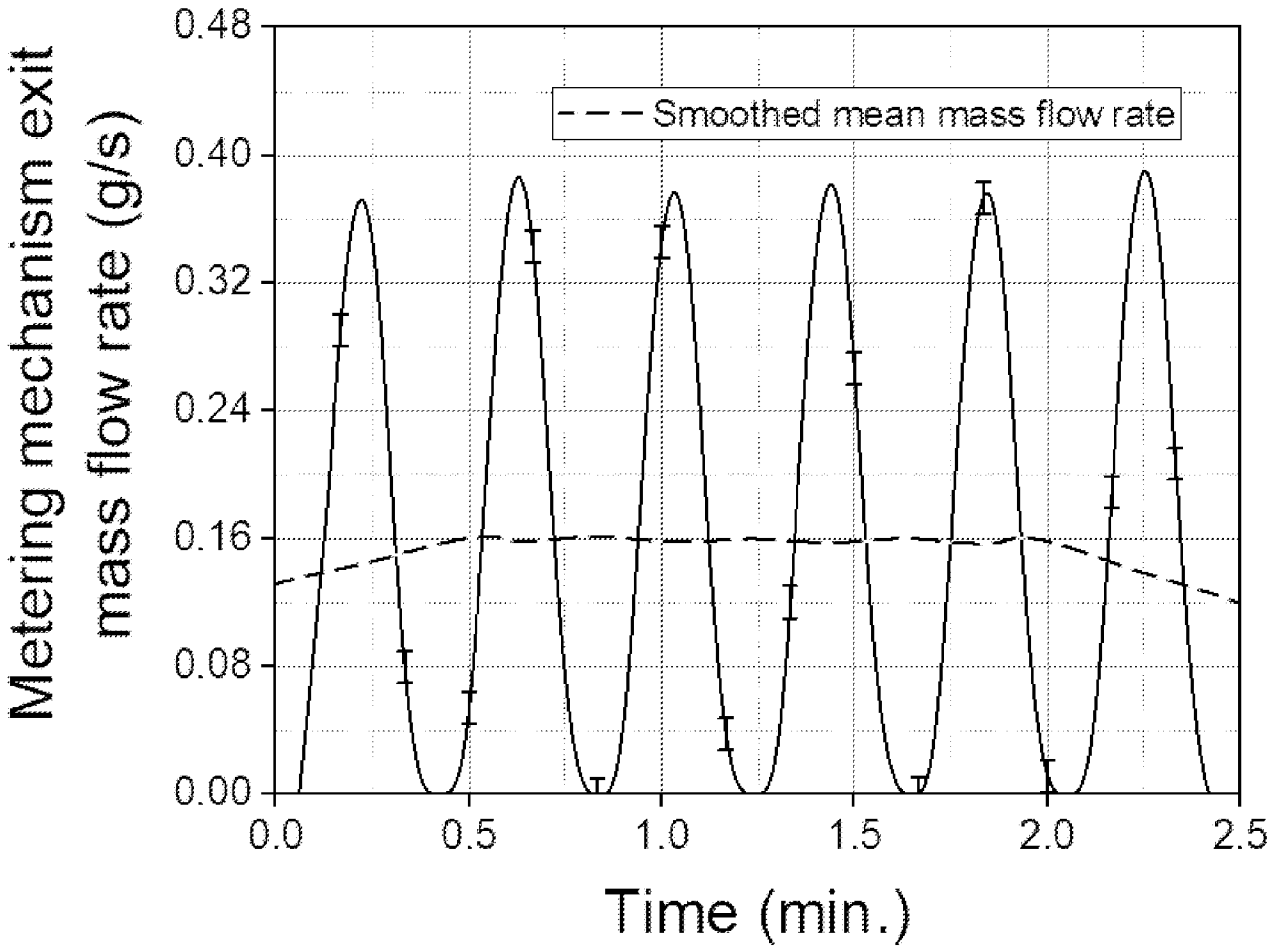
FIGS. 17A and 17B present a CAD model of grid scale reactor (FS=full scale).
Figure 17B:
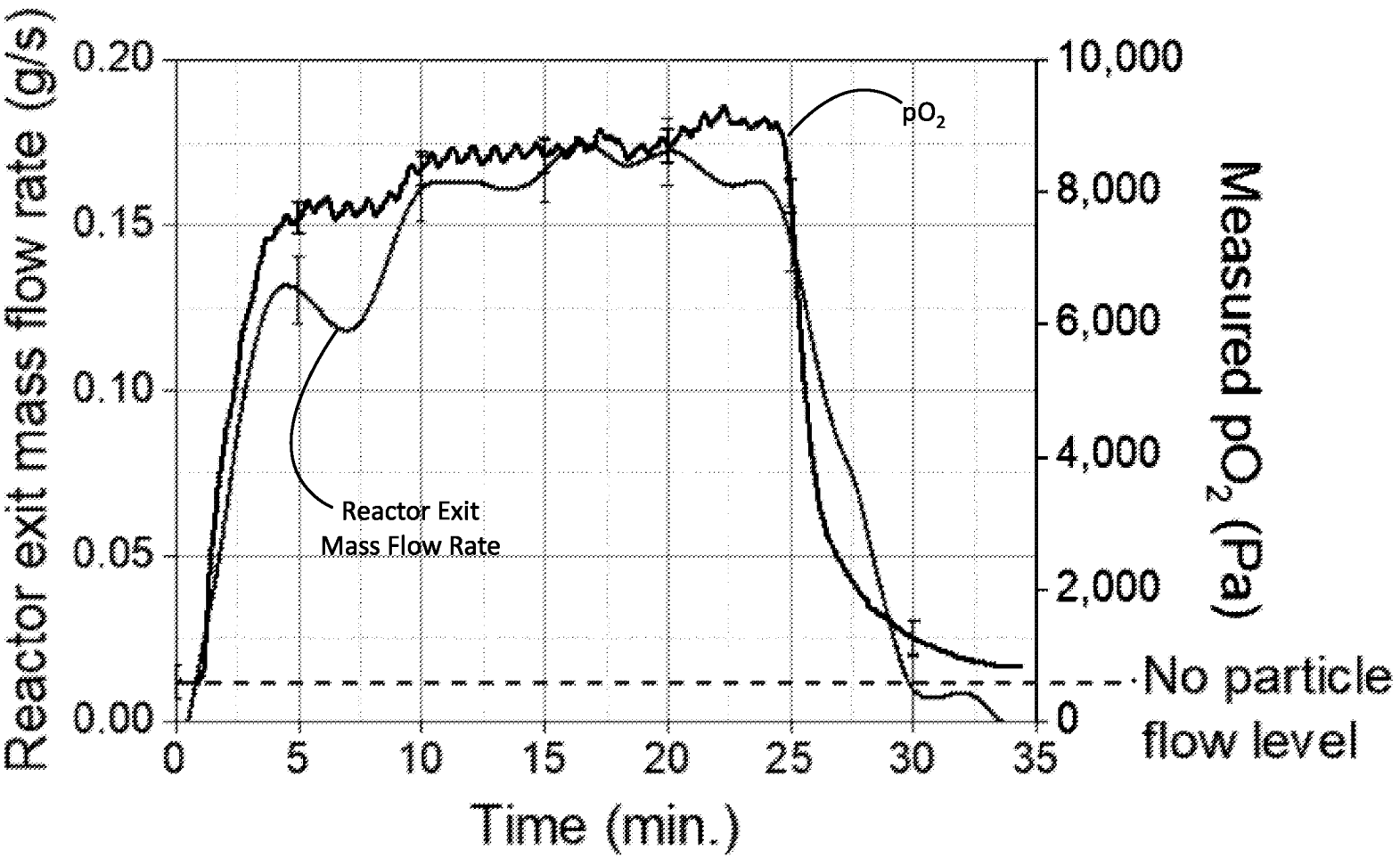

The $T_{R,exit}$ for this experiment was 823 °C and the $N_2$ purity measured before the start of particle flow was ~17 Pa. FIG. 17 illustrates the type of data collected in a typical experiment. FIG. 17A shows that the particle metering mechanism, an automated piston cylinder device, provides a mildly modulated sinusoidal particle input. In this case the average flow rate is 0.16 g/s with a cycle frequency of 0.016 Hz. FIG. 17B shows the CAM28 rate exiting the ZFR at the particle chute along with the $pO_2$ measured near the particle inlet.

After the initial transient flow (~1-2 min.), the exit CAM28 flow reaches a steady output flow of ~0.16 g/s. One to two minutes after observing particles exit the reactor, the $pO_2$ measured near the particle inlet (i.e., gas outlet) begins to rise and reaches a steady state of 8000-9000 Pa with an $N_2$ flow rate of 2 LPM. The steady state $pO_2$ modulation around a mean value shows the same frequency as the particle mass flow input (0.016 Hz), providing verification that the $O_2$ originates from the particles and that we can capture transient behavior with our measurements. After the particle supply in the feed hopper is exhausted, the particle flow rate decreases, followed very shortly by the measured $pO_2$. Note that the $pO_2$ returns to the initial no particle flow value at the end of experiment.

The gravimetrically obtained Δδ for this experiment was 0.057±0.0005. Though the $N_2$ inlet purity prior to the start of particle flow was ~17 Pa, the particles equilibrated at a much higher $\Delta pO_2$ of ~8000-9000 Pa, as observed in FIG. 10, indicating some potential internal reoxidation after the particle exit reducing the Δδ value compared to equilibrium value (~0.16 for $pO_{2,in}$=17 Pa and $T_{R,exit}$=823 °C). The main suspected reasons for this reoxidation is the $N_2$ leakage and the $pO_2$ ingress from the semi permanently sealed side reactor seams and the temperature gradient not being similar to the equilibrium temperature gradient from FIG. 9.

Thus, even though the Δδ for this experiment is much smaller than the predicted equilibrium value for the same $T_{R,out}$ (823 °C) and $pO_{2,in}$ (17 Pa), it is still 5.7 times the previous attempt with CAM28 done previously in the art at similar temperatures. This improvement in reduction performance is primarily due to change in reactor geometry from the IPR in to the ZFR.

Scaling Model

Encouraged by the experimental results, we developed a scaled model of the ZFR concept. From the discretized equilibrium reactor model, one can assume that the solid gas interactions and their effects on the δ depend only on the vertical (fixing the reactor height (hFS)) cross section of the reactor (fixing the reactor height (hFS)). This assumption is valid provided a low and uniform particle cross sectional density to maximize particle gas mixing and minimize particle-particle interactions.

Figure 18:
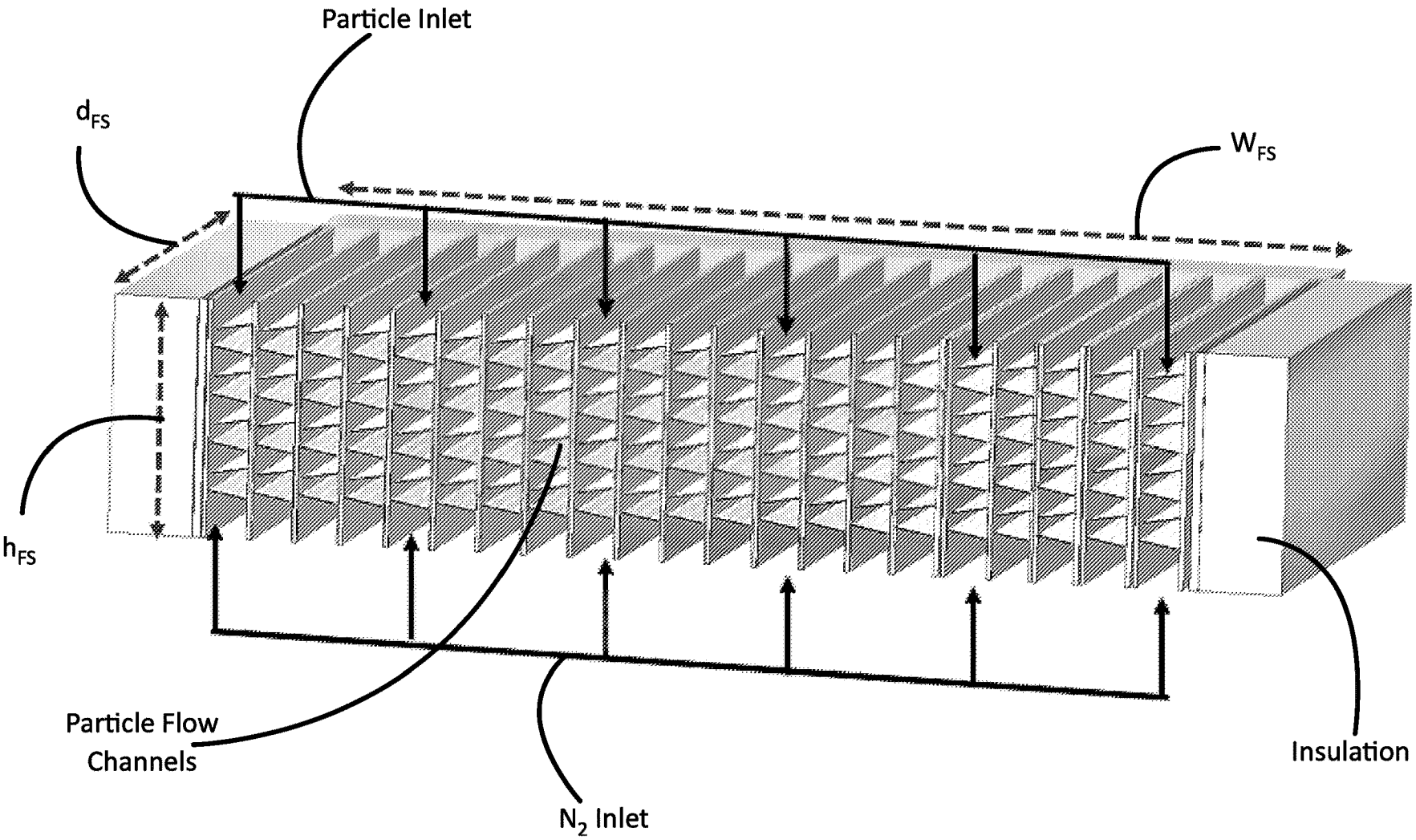
FIG. 18 shows dependence of unit cost of material storage and unit cost of output power on the total reactor output power. ΔT=550 °C, $d_{part}$=250 μm, $d_{FS}$=1000 mm, Δδ=0.2, λ=1.5.

Keeping this assumption in mind, the ZFR scales along its depth ($d_{FS}$) to accommodate the increased $MO_x$ flow required at grid scales (FIG. 18). An appropriately deep flow channel can meet any power requirements. But to avoid making an impractically deep flow channel, this disclosure selects a $d_{FS}$ of 1 m. In the scaled ZFR, multiple parallelly operating flow channels stack along its width ($w_{FS}$) to achieve significantly higher power levels. All the flow channels radiatively share heat with each other during operation. $N_2$ divides equally among the flow channels separated by a solid wall and different streams do not mix during the process. An insulating cavity surrounds all the channels from top and sides minimizing the heat loss to the surroundings.

CONCLUSIONS

This disclosure introduces the concept of the Zigzag flow reactor (ZFR) for thermal reduction of metal oxide particles with inert gas sweep for thermochemical energy storage (TCES). In the ZFR, cold metal oxide particles flow along vertically stacked inclined meshes inside a rectangular channel. The channel is externally heated to increase the particle temperature under low $pO_2$ inert gas environments to achieve thermal reduction. The ZFR represents the discretized version of the ideal countercurrent reactor recommended in the literature to approach reduction equilibrium. While the ideal reactor requires infinite steps to operate, a discretization of the ideal reactor into finite parts is possible if the particle residence time ($\tau_R$) and particle-inert gas mixing are sufficient. The equilibrium model suggests the use of a variable temperature gradient where the output temperature ($T_{R,out}$) is lower than maximum reduction temperature ($T_{R,max}$). The equilibrium model shows that an $N_2$ purity ($pO_{2,in}$) of ~1 kPa offers the most benefits in terms of cost reduction by reducting the $T_{R,max}$ compared to a purer $N_2$. This counters the common understanding in thermochemical community that a high $T_{R,max}$ and low $pO_{2,in}$ are essential for successful themrochemical reactors. Models and prototypes show that the ZFR offers both high particle gas mixing and a high $\tau_R$ allowing the accommodation of reaction kinetics and meeting the requirements of the equilibrium model. The diffusion model shows that one should consider tradeoffs between reactor parameters like particle diameter, distance between consecutive meshes in order to achieve high power densities while approaching reaction equilibrium. The proof of concept prototype of the ZFR achieved 5.7 times the reduction extent of the previous attempts with the same material and at similar temperatures. The ZFR design also offers simple scaling along the reactor depth followed by parallelly operating multiple channels that share internal walls.

What is claimed is:

1. A reactor for reducing metal oxide particles comprising:

(a) a vertical heated channel;

(b) a plurality of inclined, vertically stacked metal meshes, said meshes comprising:

(i) a particle opaque portion comprising over about 50% of the meshes' length and having openings smaller than the smallest metal oxide particle; and (ii) a particle transparent portion having openings large enough for the metal oxide particles to pass to the next level;

(c) a vibration motor coupled to the meshes; and (d) an insulated chamber for storing the metal oxide particles.

2. The reactor of claim 1, wherein the particle opaque portion comprising over about 80% of the meshes' length.

3. The reactor of claim 1, wherein the insulated chamber stores the particles under a reduced $O_2$ environment.

4. The reactor of claim 1, wherein the stacked metal meshes comprise openings that are at least 30% of the surface area of the meshes.

5. The reactor of claim 1, wherein the stacked metal meshes comprise openings that are about 40% to about 50% of the surface area of the meshes.

6. The reactor of claim 1, wherein the metal oxide particles have a particle size of about 25 μm to about 500 μm.

7. The reactor of claim 1, wherein a sweep gas (SG) flows counter current to a flow of the metal oxide particles.

8. The reactor of claim 7, wherein the SG is air, nitrogen, steam or hydrogen.

9. The reactor of claim 1, additionally comprising a hopper to feed metal oxide particles to the vertical heated chamber.

10. The reactor of claim 1, wherein the vertical heated chamber has a temperature of about 500 °C to about 1200 °C.

11. The reactor of claim 1, wherein the plurality of inclined, vertically stacked metal meshes are inclined at about 10 degrees to about 25 degrees.

12. A thermochemical energy storage reactor device comprising a reactor for reducing metal oxide particles, the reactor comprising:

(a) a vertical heated channel;

(b) a plurality of inclined, vertically stacked metal meshes, said meshes comprising:

(i) a particle opaque portion comprising over about 50% of the meshes' length and having openings smaller than the smallest particle; and (ii) a particle transparent portion having openings large enough for the metal oxide particles to pass to the next level;

(c) a vibration motor coupled to the meshes; and (d) an insulated chamber for storing the metal oxide particles.

13. The thermochemical energy storage reactor device of claim 12, wherein the particle opaque portion comprising over about 80% of the meshes' length.

14. The thermochemical energy storage reactor device of claim 12, wherein the stacked metal meshes comprise openings that are at least 30% of the surface area of the meshes.

* * * * *